US010240551B2

(12) United States Patent
Aono et al.

(10) Patent No.: US 10,240,551 B2
(45) Date of Patent: Mar. 26, 2019

(54) ELECTROMAGNETIC VALVE CONTROL UNIT AND INTERNAL COMBUSTION ENGINE CONTROL DEVICE USING SAME

(71) Applicant: Hitachi Automotive Systems, Ltd., Hitachinaka-shi, Ibaraki (JP)

(72) Inventors: Toshihiro Aono, Tokyo (JP); Motoyuki Abe, Tokyo (JP); Ryo Kusakabe, Tokyo (JP); Teppei Hirotsu, Tokyo (JP); Ayumu Hatanaka, Tokyo (JP); Hideyuki Sakamoto, Hitachinaka (JP); Takao Fukuda, Hitachinaka (JP); Masahiro Toyohara, Hitachinaka (JP); Osamu Mukaihara, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 99 days.

(21) Appl. No.: 14/784,653

(22) PCT Filed: Mar. 7, 2014

(86) PCT No.: PCT/JP2014/055903
§ 371 (c)(1),
(2) Date: Oct. 15, 2015

(87) PCT Pub. No.: WO2014/174916
PCT Pub. Date: Oct. 30, 2014

(65) Prior Publication Data

US 2016/0076498 A1 Mar. 17, 2016

(30) Foreign Application Priority Data

Apr. 26, 2013 (JP) ..... 2013-094207

(51) Int. Cl.
*F02D 41/24* (2006.01)
*F02D 41/20* (2006.01)
(Continued)

(52) U.S. Cl.
CPC ..... *F02D 41/2467* (2013.01); *F02D 41/20* (2013.01); *F02M 51/061* (2013.01);
(Continued)

(58) Field of Classification Search
CPC ..... F02M 51/00; F02M 51/06; F02M 51/061; F02D 41/20; F02D 2041/202–2041/2082;
(Continued)

(56) References Cited

U.S. PATENT DOCUMENTS 5,375,575 A 12/1994 Ohishi et al.
5,924,403 A * 7/1999 Thomas ..... F02D 41/345 123/300

(Continued)

FOREIGN PATENT DOCUMENTS

EP 2 455 600 A1 5/2012
EP 2 955 365 A1 12/2015

(Continued)

OTHER PUBLICATIONS

Extended European Search Report issued in counterpart European Application No. 14788534.7 dated Nov. 18, 2016 (4 pages).

(Continued)

*Primary Examiner* — Erick Solis
*Assistant Examiner* — Robert Werner
(74) *Attorney, Agent, or Firm* — Crowell & Moring LLP

(57) ABSTRACT

Provided are an electromagnetic valve control unit and a fuel injection control device using the same that can precisely detect a change of an operating state of an electromagnetic valve, that is, a valve opening time or a valve closing time of the electromagnetic valve, precisely correct a drive voltage or a drive current applied to the electromagnetic valve, and appropriately control opening/closing of the electromagnetic valve, with a simple configuration. In an electromagnetic valve control unit for controlling opening/closing (Continued)

of an electromagnetic valve by a drive voltage and a drive current to be applied, the drive voltage and the drive current applied to the electromagnetic valve are corrected on the basis of a detection time of an inflection point from time series data of the drive voltage and the drive current when the electromagnetic valve is opened/closed.

14 Claims, 20 Drawing Sheets

(51) Int. Cl.
*F02M 51/06* (2006.01)
*F02D 41/14* (2006.01)

(52) U.S. Cl.
CPC ..... *F02D 2041/1432* (2013.01); *F02D 2041/2051* (2013.01); *F02D 2041/2055* (2013.01); *F02D 2041/2058* (2013.01); *F02M 51/0671* (2013.01)

(58) Field of Classification Search
CPC ..... F02D 2041/1432; F02D 41/2467; F02D 2200/0618
USPC ..... 123/445, 472, 478, 490; 701/103–105
See application file for complete search history.

(56) References Cited

U.S. PATENT DOCUMENTS

| | | | | |
|---|---|---|---|---|
| 8,306,637 | B2 * | 11/2012 | Seberger | G05B 19/44 318/400.19 |
| 8,347,866 | B2 * | 1/2013 | Meyer | F02D 41/1441 123/696 |
| 2002/0130192 | A1 | 9/2002 | McCoy et al. | |
| 2009/0132180 | A1 * | 5/2009 | Pearce | F02D 41/20 702/38 |
| 2011/0170224 | A1 | 7/2011 | Gietler et al. | |
| 2011/0214741 | A1 | 9/2011 | Fukano et al. | |
| 2012/0101707 | A1 | 4/2012 | Kemmer et al. | |
| 2013/0013170 | A1 | 1/2013 | Joos et al. | |
| 2014/0069390 | A1 | 3/2014 | Nishimura et al. | |
| 2014/0366848 | A1 * | 12/2014 | Fujii | F02D 41/247 123/480 |
| 2015/0377176 | A1 | 12/2015 | Hatanaka et al. | |
| 2016/0245211 | A1 | 8/2016 | Katsurahara et al. | |

FOREIGN PATENT DOCUMENTS

| | | | |
|---|---|---|---|
| JP | 56-9626 | A | 1/1981 |
| JP | 60-36739 | A | 2/1985 |
| JP | 61-25951 | | 2/1986 |
| JP | 5-272392 | A | 10/1993 |
| JP | 6-174139 | A | 6/1994 |
| JP | 8-319879 | A | 12/1996 |
| JP | 10-160031 | A | 6/1998 |
| JP | 2001-221121 | A | 8/2001 |
| JP | 2001-280189 | A | 10/2001 |
| JP | 2002-4922 | A | 1/2002 |
| JP | 2005-61583 | A | 3/2005 |
| JP | 2005-291494 | A | 10/2005 |
| JP | 2011-179647 | A | 9/2011 |
| JP | 2014-31790 | A | 2/2014 |
| JP | 2014-55571 | A | 3/2014 |
| JP | 2014-152697 | A | 8/2014 |
| JP | 2015-96720 | A | 5/2015 |
| WO | WO 94/13991 | A1 | 6/1994 |

OTHER PUBLICATIONS

Greensted, "FIR Filters by Windowing", The Lab Book Pages, May 4, 2010, Http://www.labbookpages.co.uk/audio/firWindowing.htmw, retrieved Nov. 9, 2016, XP 055317889 (3 pages).
International Search Report (PCT/ISA/210) issued in counterpart International Application No. PCT/JP2014/055903 dated May 13, 2014, with English translation (Five (5) pages).
Japanese-language Office Action issued in counterpart Japanese Application No. 2017-126579 dated May 8, 2018 with English translation (seven (7) pages).
Japanese-language Office Action issued in counterpart Japanese Application No. 2017-126579 dated Dec. 18, 2018 with English translation (nine (9) pages).

* cited by examiner $$y(t)=h(n) \cdot x(t-n)$$

$$Y(s) = \frac{1}{1+\tau s} X(s) \quad (\tau : \text{RESPONSE TIME CONSTANT})$$

$$y(t)=h(n)\cdot x(t-n)$$

$$\begin{cases} h(n)=1-\cos\left(\dfrac{2\pi n}{T}\right) & (0\leqq n\leqq T) \\ h(n)=0 & (\text{OTHERS}) \end{cases}$$

ELECTROMAGNETIC VALVE CONTROL UNIT AND INTERNAL COMBUSTION ENGINE CONTROL DEVICE USING SAME

TECHNICAL FIELD

The present invention relates to an electromagnetic valve control unit and an internal combustion engine control device using the same and, for example, to an electromagnetic valve control unit used for an electromagnetic fuel injection valve disposed in an internal combustion engine and an internal combustion engine control device using the same.

BACKGROUND ART

Conventionally, technology for reducing the number (particulate number (PN)) of particulate matters (PM) included in exhaust gas has been developed in the auto industry, for example. As conventional technology, technology for improving a spraying characteristic of fuel injected from a fuel injection valve disposed in an internal combustion engine or reducing force of the fuel injection to suppress the fuel injected into a combustion chamber of the internal combustion engine from adhering to a wall surface is known. Particularly, as technology for reducing the force of the fuel injection, technology for dividing fuel necessary for one combustion stroke into fuel for a plurality of combustion strokes, injecting (multi-step injection) the fuel, and reducing a fuel injection amount for each combustion stroke is suggested.

However, in the case in which the fuel is injected from the fuel injection valve to the combustion chamber of the internal combustion engine, even though each fuel injection valve is driven by the same injection pulse (drive pulse to control opening/closing of the fuel injection valve) as illustrated in an upper diagram of FIG. 22, a movement of a valve element of each fuel injection valve varies on the basis of a spring characteristic or a solenoid characteristic of each fuel injection valve and a valve opening start time or a valve closing completion time of each fuel injection valve and a time width from valve opening start to valve closing completion vary as illustrated by a lower diagram of FIG. 22. That is, an injection amount of the fuel injected from the fuel injection valve to the combustion chamber of the internal combustion engine varies for each individual, according to an injection characteristic based on the spring characteristic or the solenoid characteristic of each fuel injection valve. In addition, a variation amount of the fuel injection amount is almost constant, regardless of the injection amount of the fuel injected from each fuel injection valve. For this reason, for example, when the fuel injection amount for each combustion stroke is reduced by the multi-step injection as described above, there is a problem in that a ratio of the variation amount to the fuel injection amount for each combustion stroke relatively increases and the injection amount of the fuel injected in one combustion stroke greatly deviates from a target fuel injection amount.

For the problem, technology for detecting a change of an operating state of an electromagnetic actuator configuring the fuel injection valve to change the injection pulse of each fuel injection valve according to the injection characteristic of each fuel injection valve so as to control the injection amount of the fuel injected from each fuel injection valve is disclosed in PTL 1.

A detection method disclosed in PTL 1 is a method of detecting the change of the operating state of the electromagnetic actuator from inductance of a predetermined time, in the electromagnetic actuator including an electromagnet having the inductance and a movable element controlled by the electromagnet. For example, the detection method is a method of detecting that the operating state of the actuator changes, when the inductance increases/decreases, when an inclination of a measurement value of a current passing the electromagnet changes, and when a current measurement pattern of the current passing the electromagnet and at least one of current evaluation patterns prepared previously are matched.

CITATION LIST

Patent Literature

PTL 1: US Patent No. 2011/0170224

SUMMARY OF INVENTION

Technical Problem

However, in the detection method disclosed in PTL 1, there is a problem in that it is difficult to measure the change of the inductance directly. In addition, when a change of an inclination of a current/voltage value passing the electromagnet is detected, it is necessary to execute second-order differentiation on time series data of the current/voltage value. However, because a noise included in the time series data is emphasized for each first-order differentiation, it is difficult to precisely detect the change of the inclination of the current/voltage value. In addition, the current measurement pattern (magnitude or inclination of the current value) changes according to a characteristic of a drive circuit of the electromagnetic actuator. For this reason, when the current measurement pattern of the current passing the electromagnet and at least one of the current evaluation patterns are compared, it is necessary to previously prepare the multiple current evaluation patterns capable of corresponding to the multiple current measurement patterns.

The invention has been made in view of the above problems and an object of the invention is to provide an electromagnetic valve control unit and a fuel injection control device using the same that can precisely detect a change of an operating state of an electromagnetic valve, that is, a valve opening time or a valve closing time of the electromagnetic valve, precisely correct a drive voltage or a drive current applied to the electromagnetic valve, and appropriately control opening/closing of the electromagnetic valve, with a simple configuration.

Solution to Problem

To achieve the above-described object, an electromagnetic valve control unit according to the present invention is an electromagnetic valve control unit for controlling opening/closing of an electromagnetic valve by a drive voltage and/or a drive current to be applied, wherein the drive voltage and/or the drive current applied to the electromagnetic valve is corrected on the basis of a detection time of an inflection point from time series data of the drive voltage and/or the drive current when the electromagnetic valve is opened/closed.

Advantageous Effects of Invention

As understood from the above description, according to the invention, a valve opening start time or a valve opening completion time of an electromagnetic valve and a valve closing completion time of the electromagnetic valve can be precisely detected on the basis of detection time of an inflection point from time series data of a drive voltage or a drive current when the electromagnetic valve is opened/closed. Therefore, the drive voltage or the drive current applied to the electromagnetic valve is corrected using the valve opening start time or the valve opening completion time and the valve closing completion time of the electromagnetic valve, so that opening/closing of the electromagnetic valve can be appropriately controlled.

Other objects, configurations, and effects will become more apparent from the following description of embodiments.

DESCRIPTION OF EMBODIMENTS

Hereinafter, embodiments of an electromagnetic valve control unit and an internal combustion engine control device using the same according to the present invention will be described with reference to the drawings. In this embodiment, a form in which an electromagnetic fuel injection valve to inject fuel into a combustion chamber of an internal combustion engine is adopted as an electromagnetic valve and the electromagnetic valve control unit is used in the internal combustion engine control device is described.

However, an appropriate valve that is electromagnetically driven can be adopted as the electromagnetic valve.

[First Embodiment]

Figure 1:
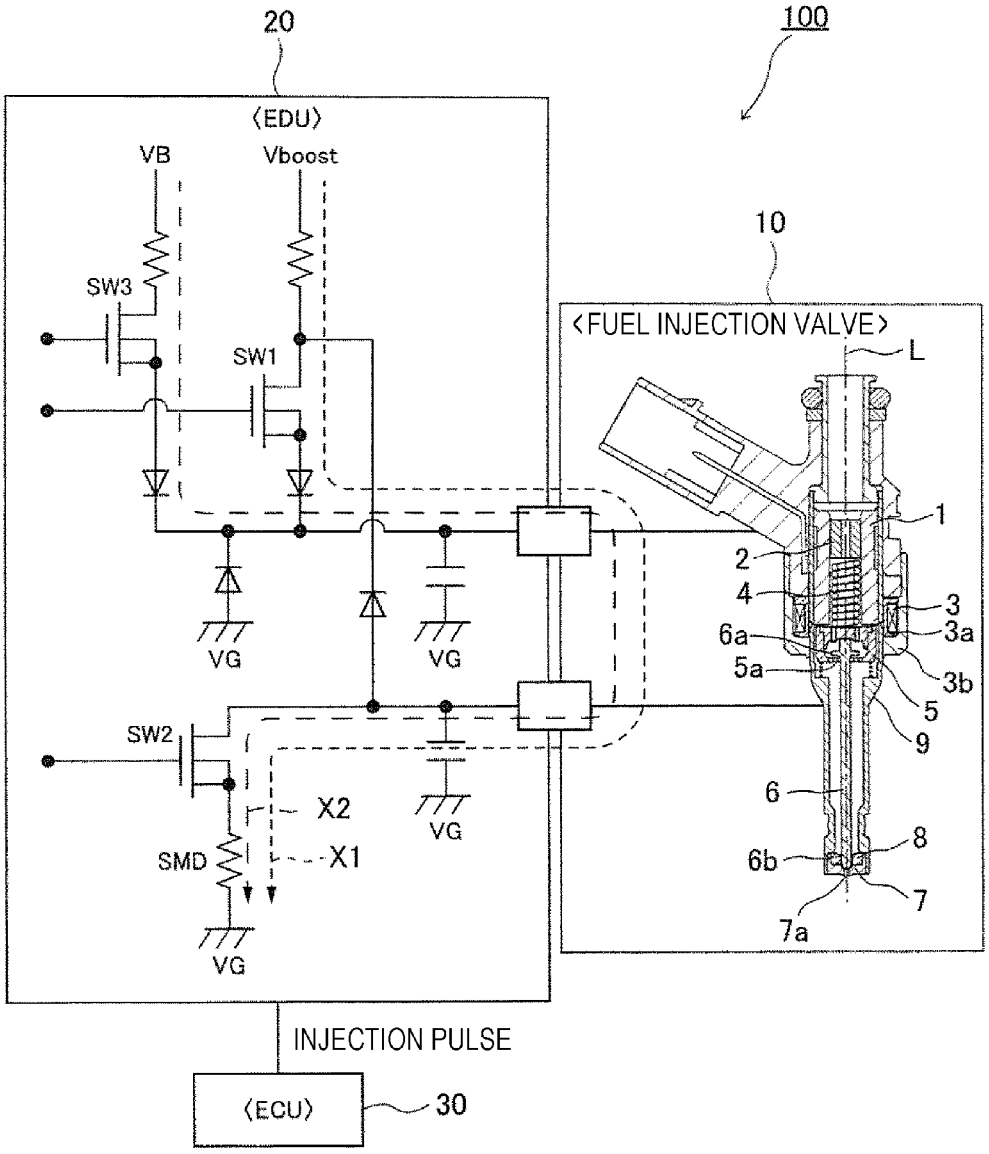
FIG. 1 is an entire configuration diagram illustrating an entire configuration of a fuel injection device to which an internal combustion engine control device using a first embodiment of an electromagnetic valve control unit according to the present invention is applied.

FIG. 1 is an entire configuration diagram illustrating an entire configuration of a fuel injection device to which an internal combustion engine control device using a first embodiment of an electromagnetic valve control unit according to the present invention is applied.

A fuel injection device 100 illustrated in the drawing mainly includes an electromagnetic fuel injection valve (electromagnetic valve) 10, an engine drive unit (EDU) (drive circuit) 20, and an engine control unit (ECU) (internal combustion engine control device) 30. The ECU 20 and the EDU 30 may be configured as separated units and may be configured to be integrated with each other.

The electromagnetic fuel injection valve 10 mainly includes a cylindrical body 9, a cylindrical fixed core 1 fixedly arranged in the cylindrical body 9, a solenoid 3 wound around a bobbin 3*a* arranged outside the fixed core 1 via the cylindrical body 9, a movable element 5 arranged relatively movably in a direction of an axis L with respect to the cylindrical body 9 below the fixed core 1, a valve element 6 relatively moving in the direction of the axis L with respect to the cylindrical body 9 according to a movement of the movable element 5, and a valve seat 7 having a valve hole (fuel injection hole) 7*a* arranged in a lower end of the cylindrical body 9 and opened/closed according to the movement of the valve element 6. In addition, a regulator 2 is press-fitted into the fixed core 1 and a set spring 4 biasing the movable element 5 in a direction of the valve seat 7 (downward direction) is disposed between the regulator 2 and the movable element 5. The solenoid is accommodated in a housing 3*b* provided outside the cylindrical body 9.

A through-hole is formed in a lower end of the movable element 5 and an upper end of the valve element 6 is inserted into the through-hole. The valve element 6 is supported to move in the direction of the axis L by a movable element guide 5*a* configured from a peripheral portion of the through-hole of the movable element 5 and a guide member 8 disposed on the valve seat 7. In addition, a protrusion portion 6*a* having an external shape relatively bigger than the through-hole of the movable element 5 is formed on the movable element guide 5*a* in the upper end of the valve element 6. When the movable element 5 moves upward, the protrusion portion 6*a* of the valve element 6 and the movable element guide 5*a* configuring the through-hole of the movable element 5 contact each other and the movable element 5 and the valve element 6 integrally move upward.

In a state in which the solenoid 3 of the electromagnetic fuel injection valve 10 is not energized, the movable element 5 is biased to the valve seat 7 by biasing force of the set spring 4, a lower end 6*b* of the valve element 6 contacts the valve seat 7, and the valve hole 7*a* formed in the valve seat 7 is closed. In addition, in a state in which the solenoid 3 is energized, magnetic attractive force attracting the movable element 5 to the fixed core 1 is generated. If the magnetic attractive force is stronger than the biasing force of the set spring 4, the movable element 5 is attracted to the fixed core 1 until the movable element 5 collides the fixed core 1, the lower end 6*b* of the valve element 6 is separated from the valve seat 7 according to the movement of the movable element 5, and the valve hole 7*a* of the valve seat 7 is opened. If energization to the solenoid 3 is stopped, the magnetic attractive force attracting the movable element 5 to the fixed core 1 disappears, the movable element 5 is biased to the valve seat 7 by the biasing force of the set spring 4, the lower end 6*b* of the valve element 6 returns to the valve seat 7, and the valve hole 7*a* is closed.

The ECU 30 calculates an injection time of fuel from the valve hole 7*a* of the fuel injection valve 10 to the combustion chamber of the internal combustion engine and a time width, on the basis of various information such as an engine rotation number, an intake air amount, and a temperature, and outputs an injection pulse setting an ON state from fuel injection start to fuel injection end and defining valve opening duration from the valve opening start to the valve closing completion of the fuel injection valve 10 to the EDU 20.

The EDU 20 boosts a battery voltage VB to several tens of volts and generates a boost voltage Vboost. The EDU 20 switches switches SW1, SW2, and SW3 between the battery voltage VB, the boost voltage Vboost, and a ground voltage VG and the solenoid 3 of the fuel injection valve 10, on the basis of the injection pulse output from the ECU 30, controls a drive voltage applied to the solenoid 3 of the fuel injection valve 10, and controls a drive current supplied to the solenoid 3.

In the fuel injection valve 10, an energization state of the solenoid 3 changes according to the drive voltage applied by the EDU 20, opening/closing of the valve hole 7*a* of the fuel injection valve 10 is controlled as described above, and fuel of a desired amount is injected from the valve hole 7*a* for a predetermined time.

Figure 2:
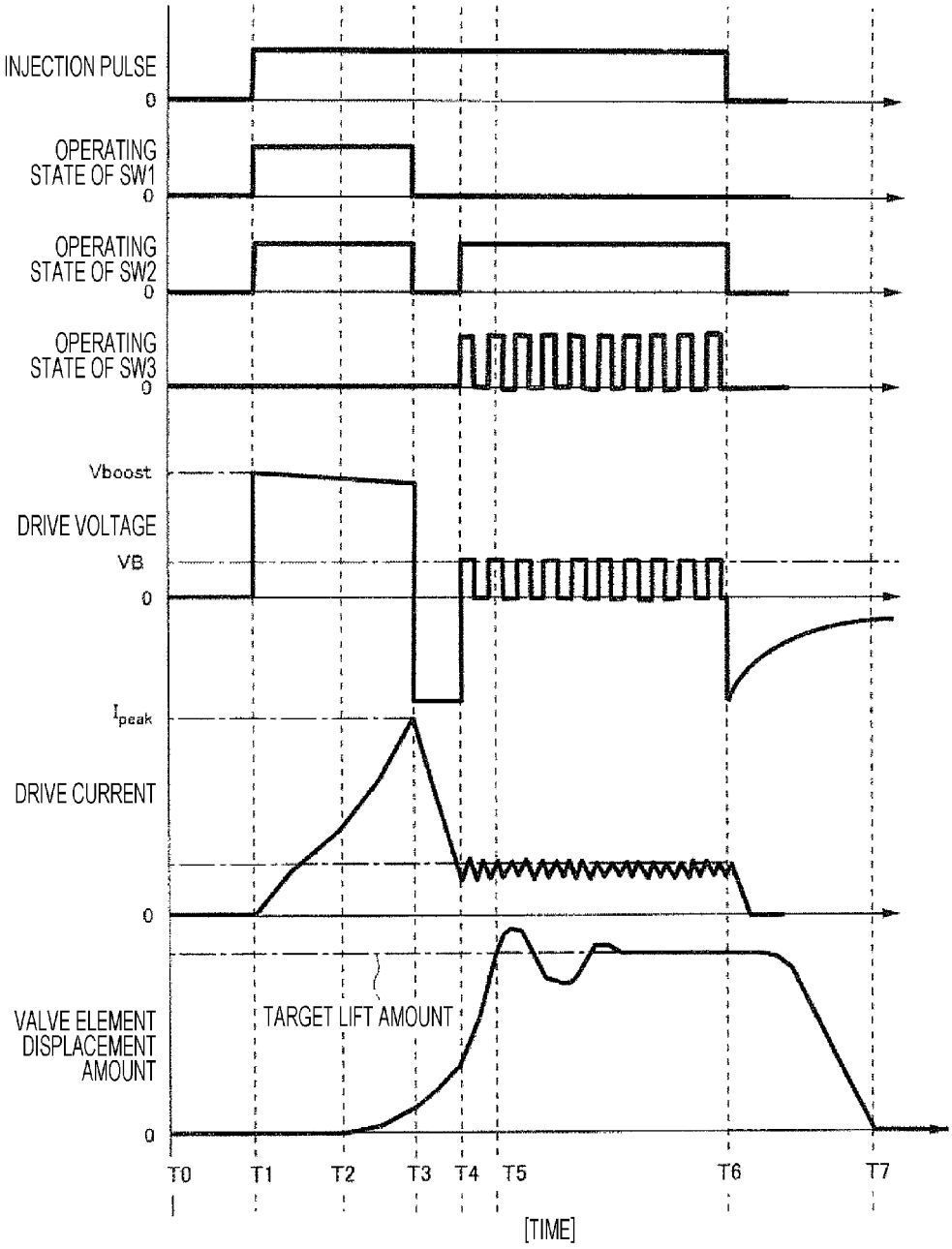
FIG. 2 is a diagram time-serially illustrating an example of an injection pulse, operating states of switches, a drive voltage, a drive current, and a displacement amount of a valve element when fuel is injected from a fuel injection valve illustrated in FIG. 1.

Referring to FIG. 2, the injection pulse output from the ECU 30, the operating states of the switches SW1, SW2, and SW3 of the EDU 20, the drive voltage and the drive current applied to the solenoid 3 of the fuel injection valve 10, and the displacement amount of the valve element 6 will be described specifically. FIG. 2 time-serially illustrates an example of the injection pulse, the operating states of the switches, the drive voltage, the drive current, and the displacement amount of the valve element when the fuel is injected from the fuel injection valve 10 illustrated in FIG. 1.

The drive voltage may be measured by a voltage between two points with the solenoid 3 of the fuel injection valve 10 therebetween, may be measured by a voltage between a voltage of an application side of the battery voltage VB or the boost voltage Vboost and the ground voltage VG, and may be measured by a voltage between a ground side (LowSide terminal) of the solenoid 3 and the ground voltage VG. In addition, the drive current is converted from a voltage applied to a shunt resistor SMD interposed between the ground side of the solenoid 3 and the ground voltage VG (refer to FIG. 1).

At times T0 to T1, the injection pulse output from the ECU 30 is turned off, all of the switches SW1, SW2, and SW3 of the EDU 20 are turned off, and the drive current is not supplied to the solenoid 3 of the fuel injection valve 10. Therefore, the movable element 5 and the valve element 6 of the fuel injection valve 10 are biased in a valve closing direction of the valve seat 7 by the biasing force of the set spring 4, the lower end 6*b* of the valve element 6 adheres closely to the valve seat 7, the valve hole 7*a* is closed, and the fuel is not injected from the valve hole 7*a*.

Next, at the time T1, if the injection pulse is turned on, the switches SW1 and SW2 are turned on, the boost voltage Vboost, the solenoid 3, and the ground voltage VG are conducted (the drive voltage of the solenoid 3 is Vboost), and the drive current is supplied to the solenoid 3 (flow of a current shown by an arrow X1 in FIG. 1), magnetic flux passes through a portion between the fixed core 1 and the movable element 5 and the magnetic attractive force acts on the movable element 5. If the drive current supplied to the solenoid 3 increases and the magnetic attractive force acting on the movable element 5 is stronger than the biasing force by the set spring 4, the movable element 5 is attracted in a direction of the fixed core 1 and starts to move (times T1 to T2). If the movable element 5 moves by a predetermined length (contact length of the movable element guide 5*a* of the movable element 5 and the protrusion portion 6*a* of the valve element 6), the movable element 5 and the valve element 6 are integrated with each other and start to move in the direction of the axis L (time T2), the lower end 6*b* of the valve element 6 is separated from the valve seat 7, the valve hole 7*a* is opened, and the fuel is injected from the valve hole 7*a*.

The movable element 5 and the valve element 6 move integrally until the movable element 6 collides the fixed core 1. However, if the movable element 6 and the fixed core 1 collide vigorously, the movable element 5 is splashed by the fixed core 1 and a flow rate of the fuel injected from the valve hole 7*a* becomes irregular. Therefore, at a time T3 before the movable element 5 collides the fixed core 1, the switches SW1 and SW2 are turned off, the drive voltage applied to the solenoid 3 is decreased, the drive current is decreased from a peak value $I_{peak}$, and the vigor of the movable element 5 and the valve element 6 is decreased.

In addition, only the magnetic attractive force sufficient for attracting the valve element 6 and the movable element 5 to the fixed core 1 is applied from a time T4 to a time T6 when the injection pulse falls. For this reason, the switch SW3 is intermittently turned on (PMW control of the switch SW3) in a state in which the switch SW2 is maintained in an ON state, the drive voltage applied to the solenoid 3 is intermittently set to the battery voltage VB, and the drive current flowing to the solenoid 3 is controlled to be settled in a predetermined range (flow of a current shown by an arrow X2 in FIG. 1). At a time T5, the movable element 5 and the fixed core 1 collide each other and the valve element 6 is displaced to a target lift amount.

At the time T6, if the injection pulse is turned off, all of the switches SW1, SW2, and SW3 are turned off, the drive voltage of the solenoid 3 decreases, and the drive current flowing to the solenoid 3 decreases, the magnetic flux generated between the fixed core 1 and the movable element 5 gradually disappears, the magnetic attractive force acting on the movable element 5 disappears, and the valve element 6 returns to a valve closing direction of the valve seat 7 with delay of predetermined time, by the biasing force of the set spring 4 and the pressing force by the fuel pressure. In addition, at a time T7, the valve element 6 returns to an original position, the lower end 6*b* of the valve element 6 adheres closely to the valve seat 7, the valve hole 7*a* is closed, and the fuel is not injected from the valve hole 7*a*.

Here, the ECU 30 precisely detects the valve opening start time T2 and the valve closing completion time T7 of the valve hole 7*a* of the fuel injection valve 10 and generates an appropriate injection pulse, such that a time from the valve opening start time T2 to the valve closing completion time T7 is matched with a target time width. As a result, a variation of an injection amount according to an injection characteristic based on the spring characteristic or the solenoid characteristic of the fuel injection valve 10 is suppressed and the injection amount of the fuel injected from the valve hole 7*a* of the fuel injection valve 10 can be approximated to a target fuel injection amount.

Figure 3:
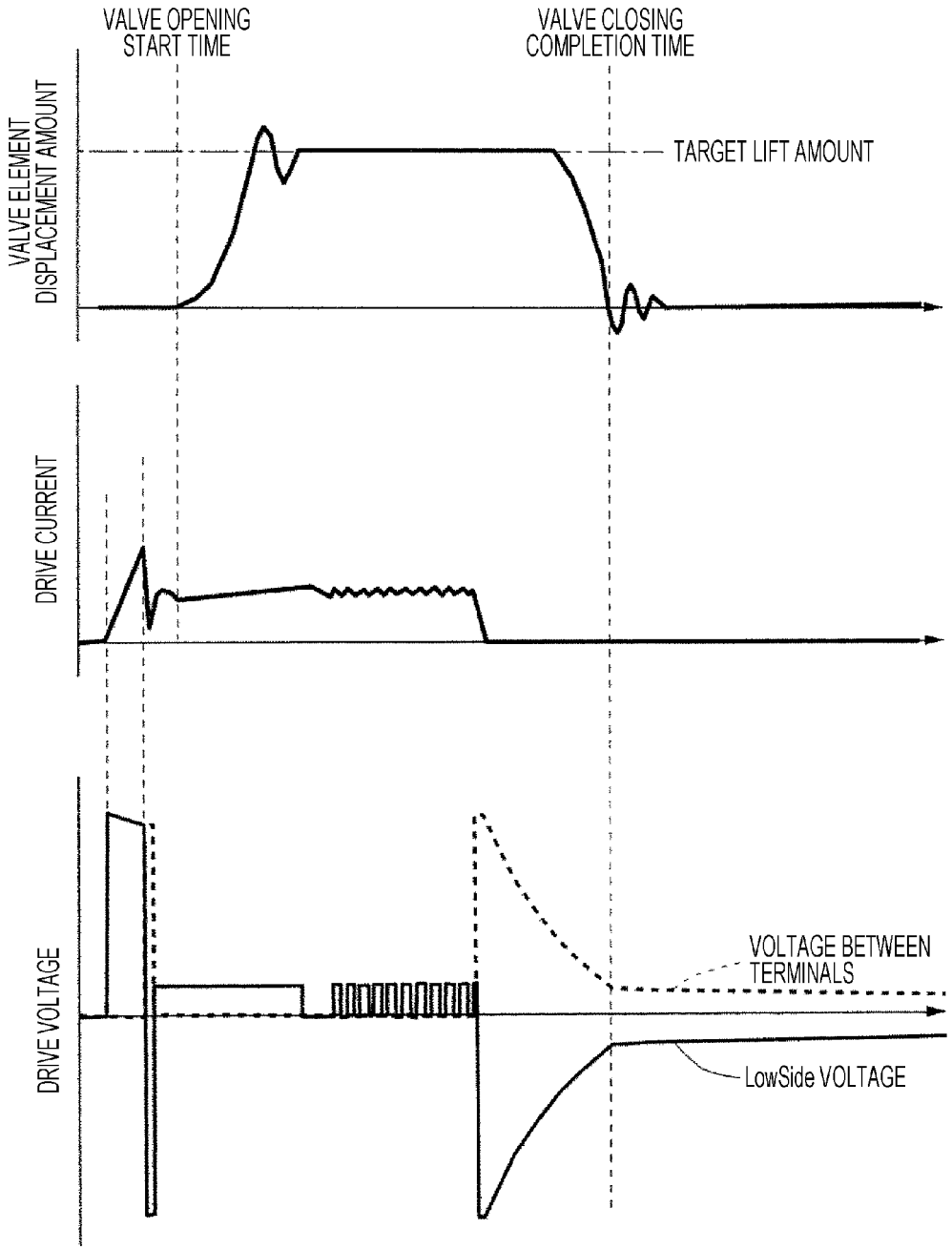
FIG. 3 is a diagram time-serially illustrating an example of a displacement amount of a valve element, a drive voltage, and a drive current when the drive voltage is relatively small.
Figure 4:
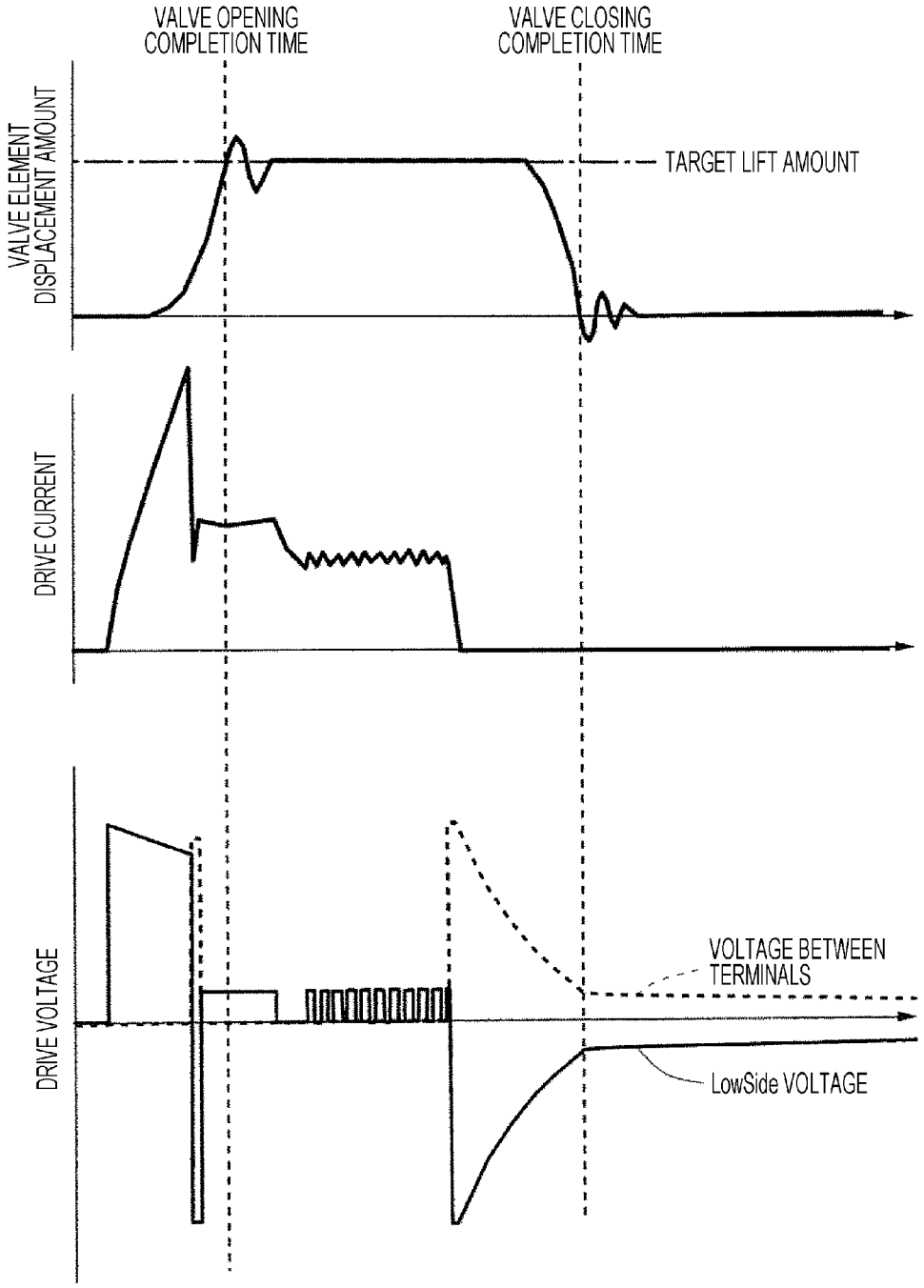
FIG. 4 is a diagram time-serially illustrating an example of a displacement amount of a valve element, a drive voltage, and a drive current when the drive voltage is relatively large.

Referring to FIGS. 3 to 6(*c*), a method of detecting the valve opening start time or the valve opening completion time and the valve closing completion time of the valve hole 7*a* of the fuel injection valve 10 relating to generation of the injection pulse of the ECU 30 will be described specifically. FIG. 3 time-serially illustrates an example of a displacement amount of the valve element, a drive voltage, and a drive current when the drive voltage is relatively small. FIG. 4 time-serially illustrates an example of a displacement amount of the valve element, a drive voltage, and a drive current when the drive voltage is relatively large. In the drive voltages of FIGS. 3 and 4, a voltage (LowSide voltage) between the ground side of the solenoid 3 and the ground voltage VG is shown by a solid line and a voltage between two points (voltage between terminals) with the solenoid 3 of the fuel injection valve 10 therebetween is shown by a broken line. In addition, FIG. 5(*a*) time-serially illustrates an example of a drive current and a normalized valve element displacement amount, FIG. 5(*b*) time-serially illustrates an example of first-order differentiation of the drive current and the normalized valve element displacement amount, and FIG. 5(*c*) time-serially illustrates an example of second-order differentiation of the drive current and the normalized valve element displacement amount. In addition, FIG. 6(*a*) time-serially illustrates an example of a drive voltage and a normalized valve element displacement amount, FIG. 6(*b*) time-serially illustrates an example of first-order differentiation of the drive voltage and the normalized valve element displacement amount, and FIG. 6(*c*) time-serially illustrates an example of second-order differentiation of the drive voltage and the normalized valve element displacement amount.

The method of detecting the valve opening start time or the valve opening completion time and the valve closing completion time of the valve hole 7*a* of the fuel injection valve 10 is described generally. When the valve hole 7*a* of the fuel injection valve 10 is opened, as described above, the relatively large drive voltage is applied to the solenoid 3 once, the relatively large drive current flows to the solenoid 3, and the movable element 5 and the valve element 6 are accelerated. Next, if the drive voltage applied to the solenoid 3 is blocked, the drive current flowing to the solenoid 3 decreases to a predetermined value, and the relatively small constant drive voltage is applied to the solenoid 3, the movable element 5 collides the fixed core 1, in a state in which the drive current flowing to the solenoid 3 is stabilized. If the movable element 5 and the fixed core 1 collide each other, acceleration of the movable element 5 changes, so that inductance of the solenoid 3 changes. Here, it is thought that a change of the inductance of the solenoid 3 is represented by a change of the drive current flowing to the solenoid 3 or the drive voltage applied to the solenoid 3. However, when the valve hole 7*a* is opened (specifically, the valve opening start time or the valve opening completion time), the drive voltage is maintained almost constantly. For this reason, the valve opening start time or the valve opening completion time can be detected from the change of the drive current flowing to the solenoid 3.

Meanwhile, when the valve hole 7*a* of the fuel injection valve 10 is closed, the valve element 6 collides the valve seat 7 and the acceleration of the movable element 5 changes. As a result, the inductance of the solenoid 3 changes. When the valve hole 7*a* is closed (specifically, the valve closing completion time), the drive current flowing to the solenoid 3 becomes 0. Therefore, the valve closing completion time can be detected from the change of the drive voltage applied to the solenoid 3.

As illustrated in FIG. 3, in the case in which the drive voltage applied to the solenoid 3 of the fuel injection valve 10 is relatively small and the drive current flowing to the solenoid 3 is relatively stable when the movable element guide 5*a* of the movable element 5 and the protrusion portion 6*a* of the valve element 6 contact each other and the valve element 6 starts to move, the drive current flowing to the solenoid 3 slightly changes at a point of time when the movable element guide 5*a* of the movable element 5 and the protrusion portion 6*a* of the valve element 6 contact each other and the valve hole 7*a* starts to be opened. Therefore, the valve opening start time can be detected from a time when an inflection point is detected from time series data of the drive current of the solenoid 3.

In addition, when the movable element 5 and the valve element 6 move downward, the lower end 6*b* of the valve element 6 contacts the valve seat 7, and the valve hole 7*a* of the fuel injection valve 10 is closed, the drive current flowing to the solenoid 3 is 0, only the drive voltage is applied to the solenoid 3, and only the drive voltage applied to the solenoid 3 slightly changes at a point of time when the valve hole 7*a* is closed. Therefore, the valve closing completion time can be detected from a time when an inflection point is detected from time series data of the drive voltage of the solenoid 3.

In addition, as illustrated in FIG. 4, in the case in which the drive voltage applied to the solenoid 3 of the fuel injection valve 10 is relatively large and it is difficult to detect the change of the drive current flowing to the solenoid 3 at a point of time when the movable element guide 5*a* of the movable element 5 and the protrusion portion 6*a* of the valve element 6 contact each other and the valve hole 7*a* is opened, the drive current flowing to the solenoid 3 changes at a point of time when the movable element 5 and the fixed core 1 collide each other (a displacement amount of the valve element 6 reaches a target lift amount) and opening of the valve hole 7*a* is completed. Therefore, the valve opening completion time can be detected from a time when an inflection point is detected from time series data of the drive current of the solenoid 3.

Figure 5A:
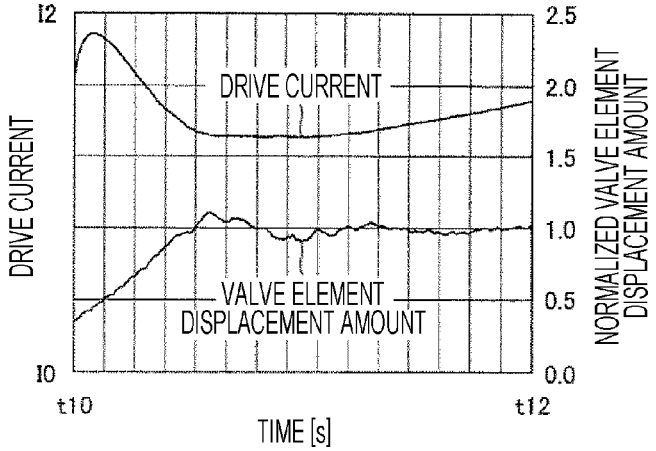
FIG. 5A is a diagram time-serially illustrating an example of a drive current and a normalized valve element displacement amount.
Figure 5B:
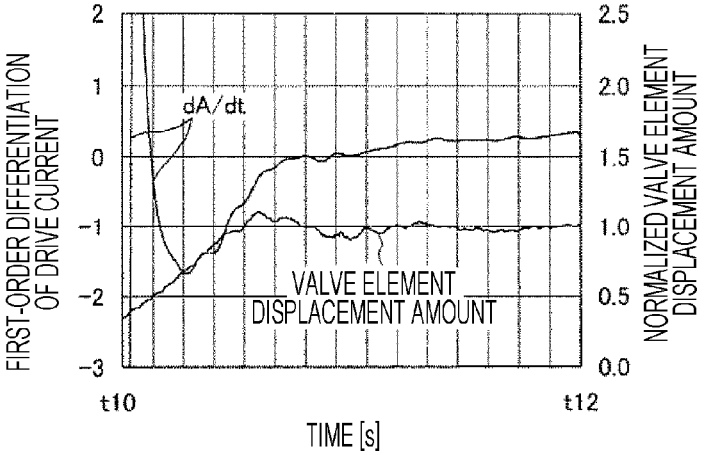
FIG. 5B is a diagram time-serially illustrating an example of first-order differentiation of the drive current and the normalized valve element displacement amount.
Figure 5C:
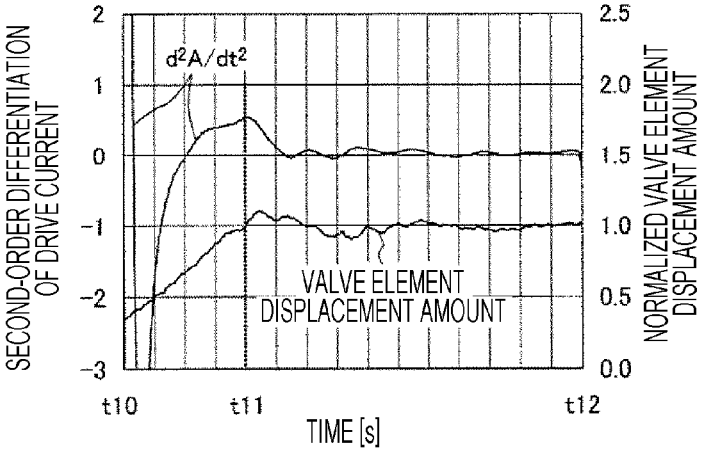
FIG. 5C is a diagram time-serially illustrating an example of second-order differentiation of the drive current and the normalized valve element displacement amount.

More specifically, as illustrated in FIGS. 5(*a*) to 5(*c*), a time (t11 in FIG. 5(*c*)) closest to the valve opening completion time becoming a preset reference in a time when second-order differentiation is executed on the time series data of the drive current flowing to the solenoid 3 of the fuel injection valve and a maximum value is detected from the second-order differentiation of the time series data of the drive current thereof can be specified as the valve opening completion time (time when the displacement amount of the valve element 6 reaches the target lift amount and opening of the valve hole 7*a* is completed). The time when the maximum value is detected from the second-order differentiation of the time series data of the drive current is a time when the inflection point is detected from the time series data of the drive current.

Figure 6A:
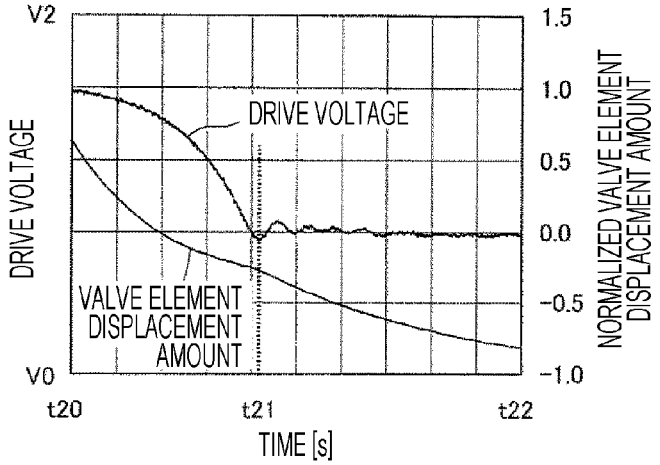
FIG. 6A is a diagram time-serially illustrating an example of a drive voltage and a normalized valve element displacement amount.
Figure 6B:
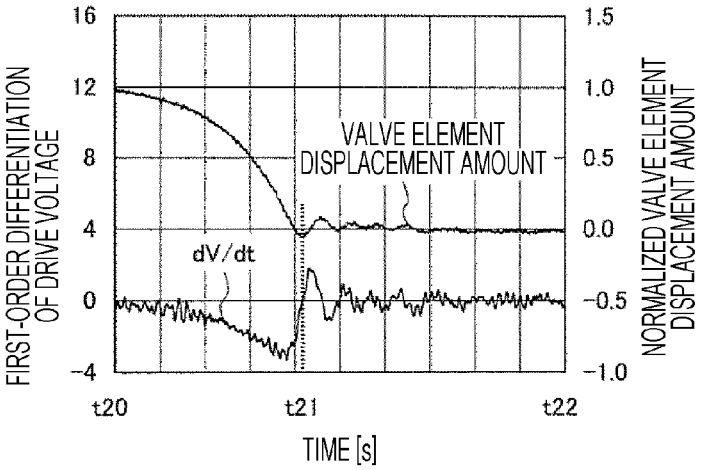
FIG. 6B is a diagram time-serially illustrating an example of first-order differentiation of the drive voltage and the normalized valve element displacement amount.
Figure 6C:
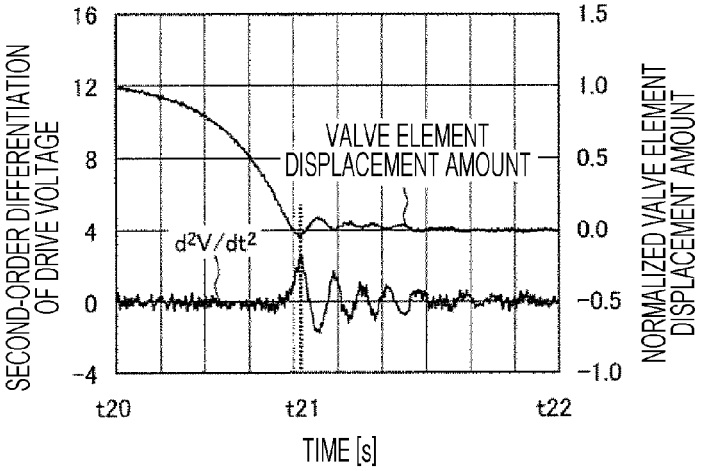
FIG. 6C is a diagram time-serially illustrating an example of second-order differentiation of the drive voltage and the normalized valve element displacement amount.

In addition, as illustrated in FIGS. 6(*a*) to 6(*c*), a time (t21 in FIG. 6(*c*)) closest to the valve closing completion time becoming a preset reference in a time when the second-order differentiation is executed on the time series data of the drive voltage applied to the solenoid 3 of the fuel injection valve and a maximum value is detected from the second-order differentiation of the time series data of the drive voltage thereof can be specified as the valve closing completion time (time when the valve element 6 returns to the original position and closing of the valve hole 7*a* is completed). The time when the maximum value is detected from the second-order differentiation of the time series data of the drive voltage is a time when the inflection point is detected from the time series data of the drive voltage.

However, when an S/N ratio of the measured drive current or drive voltage is low and a noise level thereof is high or when resolution of A/D conversion is low, it becomes difficult to detect a desired extreme value (maximum value or minimum value) from a result of the second-order differentiation of the time series data of the drive current or the drive voltage.

Figure 7A:
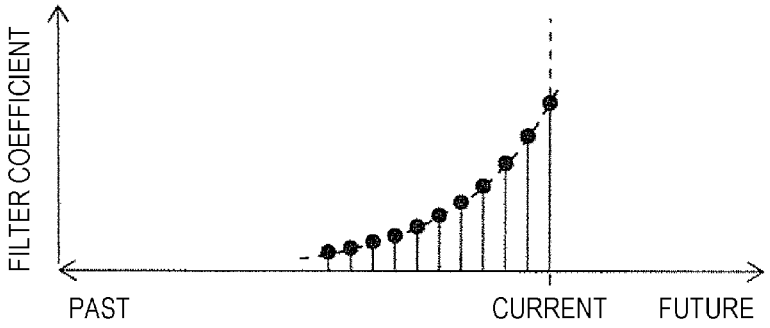
FIGS. 7A and 7B are diagrams illustrating a primary delay low-pass filter used when an inflection point is detected from a drive current or a drive voltage and FIG. 7A is a diagram illustrating a filter coefficient thereof and FIG. 7B is a diagram illustrating a frequency-gain characteristic thereof.
Figure 7B:
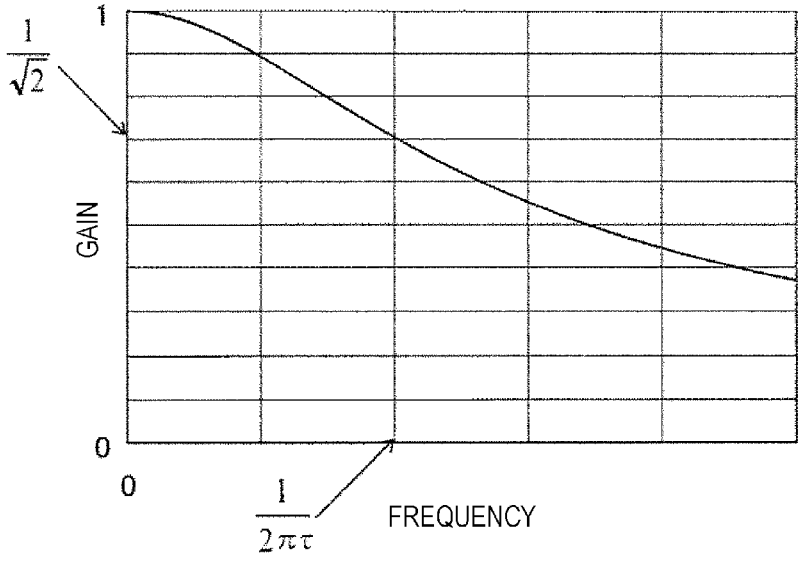

For example, when the noise level is low, the ECU 30 has a filter coefficient of which a relation of X(s) and Y(s) of the Laplace transform of an output is represented by the following formula (1) and which is illustrated in FIG. 7(*a*). The ECU 30 applies a primary delay low-pass filter of a frequency-gain characteristic illustrated in FIG. 7(*b*) to data of the drive current or the drive voltage and executes the second-order differentiation, so that a desired extreme value is detected from a result of the second-order differentiation of the time series data of the drive current or the drive voltage.

[Mathematical Formula 1]

$$Y(s) = \frac{X(s)}{1 + \tau s} \text{ (}\tau\text{: Response time constant)} \tag{1}$$

Meanwhile, a frequency characteristic moderately changes in the primary delay low-pass filter illustrated in FIG. 7(*a*) as illustrated in FIG. 7(*b*). For this reason, for example, when the noise level is high, it is difficult to efficiently remove the noise from the data of the drive current or the drive voltage. Therefore, when the noise level is high or when the resolution of the A/D conversion is low, the ECU 30 has a filter coefficient illustrated in the following formula (2) and FIG. 8(*a*). The ECU 30 applies a Hanning Window of a frequency-gain characteristic illustrated in FIG. 8(*b*) to a signal of the drive current or the drive voltage and executes the second-order differentiation, so that a desired extreme value is detected from a result of the second-order differentiation of the time series data of the drive current or the drive voltage while the noise is efficiently removed from the data of the drive current or the drive voltage.

[Mathematical Formula 2]

$$\begin{cases} h(n) = 1 - \cos\left(\frac{2\pi n}{T}\right) & (0 \le n \le T) \\ h(n) = 0 & \text{(Others)} \end{cases} \tag{2}$$

Figure 9:
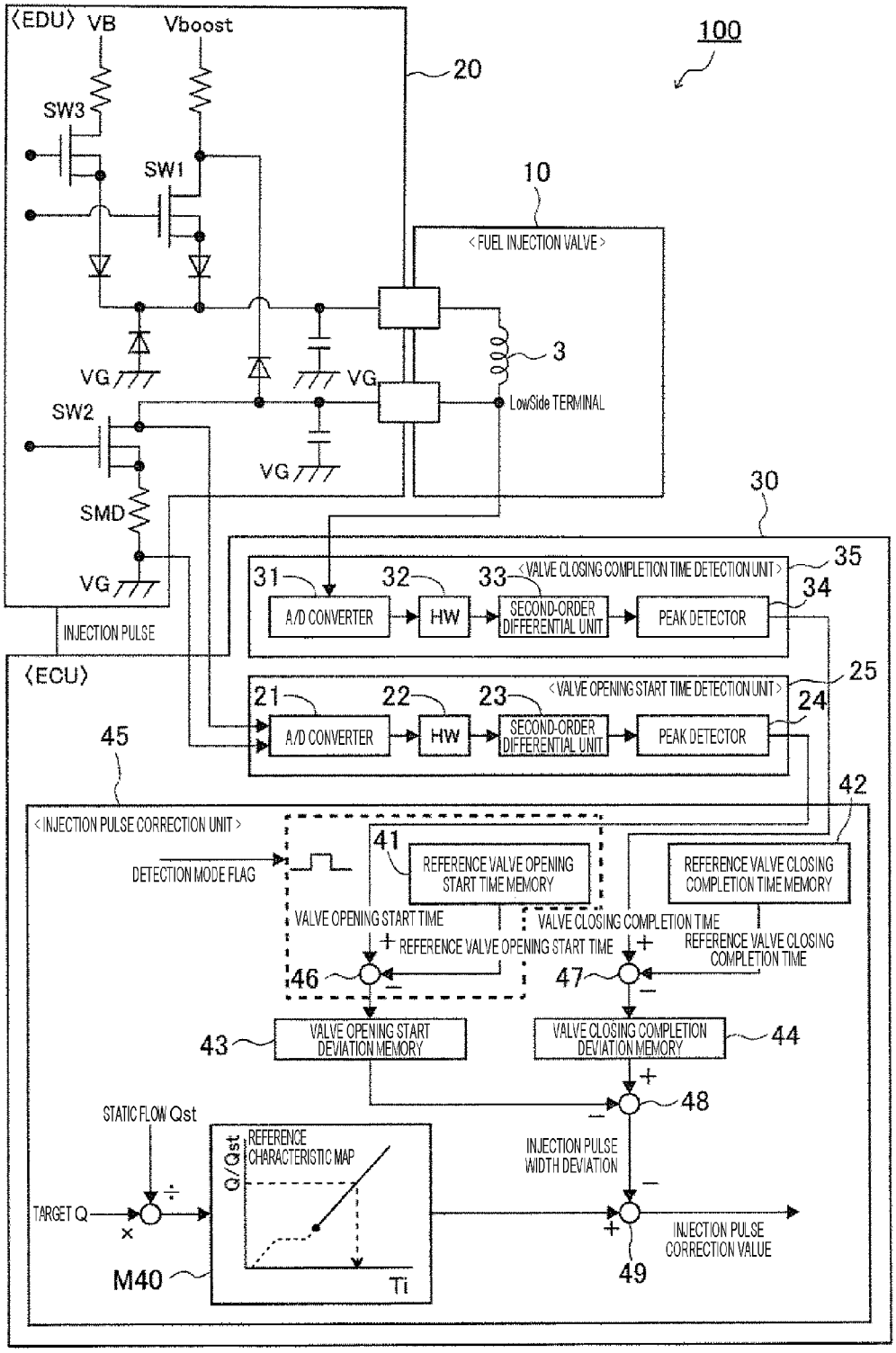
FIG. 9 is an internal configuration diagram schematically illustrating an example of an internal configuration of an ECU illustrated in FIG. 1.

FIG. 9 schematically illustrates an example of an internal configuration of the ECU illustrated in FIG. 1. In FIG. 9, the case in which, when the drive voltage applied to the solenoid 3 of the fuel injection valve 10 is relatively small and the drive current flowing to the solenoid 3 is relatively stable at a point of time when the movable element 5 and the valve element 6 contact each other and the valve element 6 starts to move, as described on the basis of FIG. 3, the valve opening start time or the valve closing completion time can be detected from the time when the inflection point can be detected from the time series data of the drive current or the drive voltage of the solenoid 3 will be described. In addition, only the solenoid 3 in the configuration of the fuel injection valve 10 is illustrated in FIG. 9.

As illustrated in the drawing, the ECU 30 mainly includes a valve opening start time detection unit 25 that detects a time corresponding to the valve opening start time, a valve closing completion time detection unit 35 that detects a time corresponding to the valve closing completion time, and an injection pulse correction unit 45 that corrects an injection pulse output to the EDU 20 using the valve opening start time detected by the valve opening start time detection unit 25 and the valve closing completion time detected by the valve closing completion time detection unit 35.

The valve opening start time detection unit 25 of the ECU 30 has an A/D converter 21 that executes A/D conversion on the voltage applied to the shunt resistor SMD provided between the LowSide terminal of the solenoid 3 of the fuel injection valve 10 and the ground voltage VG and obtains a signal proportional to a drive current, a Hanning Window 22 that smoothes a digitized drive current signal, a second-order differential unit 23 that calculates a second-order difference of the signal smoothened by the Hanning Window 22, and a peak detector 24 that detects an extreme value from the signal in which the second-order difference is calculated by the second-order differential unit 23 and an inflection point is emphasized. The valve opening start time detection unit 25 of the ECU 30 specifies a time closest to the reference valve opening start time becoming a preset reference in a time when the extreme value is detected by the peak detector 24, detects a time corresponding to the valve opening start time from a signal proportional to the drive current flowing to solenoid 3, and transmits the detected valve opening start time to the injection pulse correction unit 45.

In addition, the valve closing completion time detection unit 35 of the ECU 30 has an A/D converter 31 that executes A/D conversion on a voltage (drive voltage) of the LowSide terminal of the solenoid 3 of the fuel injection valve 10, a Hanning Window 32 that smoothes a digitized current signal, a second-order differential unit 33 that calculates a second-order difference of the signal smoothened by the Hanning Window 32, and a peak detector 34 that detects an extreme value from the signal in which the second-order difference is calculated by the second-order differential unit 33 and an inflection point is emphasized. The valve closing completion time detection unit 35 of the ECU 30 specifies a time closest to the reference valve closing completion time becoming a preset reference in a time when the extreme value is detected by the peak detector 34, detects a time corresponding to the valve closing completion time from the drive voltage applied to the solenoid 3, and transmits the detected valve closing completion time to the injection pulse correction unit 45.

In addition, the injection pulse correction unit 45 of the ECU 30 mainly has a reference characteristic map M40 that shows a relation of a value obtained by dividing a target fuel injection amount Q by a static flow (flow rate of a fully lifted state of the fuel injection valve 10) Qst and a reference injection pulse width Ti based on a flow rate characteristic of the fuel injection valve 10, a reference valve opening start time memory 41 that stores a valve opening start time becoming a reference, a reference valve closing completion time memory 42 that stores a valve closing completion time becoming a reference, a valve opening start deviation memory 43 that smoothes a variation for each injection and stores a valve opening start deviation of the valve opening start time transmitted from the valve opening start time detection unit 25 and the reference valve opening start time output from the reference valve opening start time memory 41, and a valve closing completion deviation memory 44 that smoothes a variation for each injection and stores a valve closing completion deviation of the valve closing completion time transmitted from the valve closing completion time detection unit 35 and the reference valve closing completion time output from the reference valve closing completion time memory 42. Here, even though the fuel is injected from the same fuel injection valve 10 under the same operating condition, the opening/closing time of the valve hole 7*a* of the fuel injection valve 10 slightly varies (shot variation) for each injection. For this reason, the valve opening start deviation memory 43 and the valve closing completion deviation memory 44 average a plurality of valve opening start deviations and a plurality of valve closing completion deviations detected when the fuel is injected several times from the fuel injection valve 10 and store a valve opening start deviation and a valve closing completion deviation averaged as a valve opening start deviation and a valve closing completion deviation.

If a valve opening start detection mode flag is set, the injection pulse correction unit 45 calculates a deviation of the valve opening start time transmitted from the valve opening start time detection unit 25 and the reference valve opening start time output from the reference valve opening start time memory 41 by a differential unit 46 and stores a calculation result as a valve opening start deviation in the valve opening start deviation memory 43. In addition, the injection pulse correction unit 45 calculates a deviation of the valve closing completion time transmitted from the valve closing completion time detection unit 35 and the reference valve closing completion time output from the reference valve closing completion time memory 42 by a differential unit 47 and stores a calculation result as a valve closing completion deviation in the valve closing completion deviation memory 44.

Next, the injection pulse correction unit 45 calculates an injection pulse width deviation of the valve opening start deviation output from the valve opening start deviation memory 43 and the valve closing completion deviation output from the valve closing completion deviation memory 44 by a differential unit 48, calculates a deviation of the reference injection pulse width Ti output from the reference characteristic map M40 and the injection pulse width deviation by a differential unit 49, and generates a new injection pulse (injection pulse correction value) defining valve opening duration from the valve opening start to the valve closing completion.

The ECU 30 controls (feedback control) an operating state of each of the switches SW1, SW2, and SW3 of the EDU 20, on the basis of the injection pulse correction value, controls the drive voltage applied to the solenoid 3 of the fuel injection valve 10 or the drive current flowing to the solenoid 3, appropriately controls opening/closing of the valve hole 7*a* of the fuel injection valve 10, and controls the injection amount of the fuel injected from the fuel injection valve 10 to become a target fuel injection amount.

Figure 10:
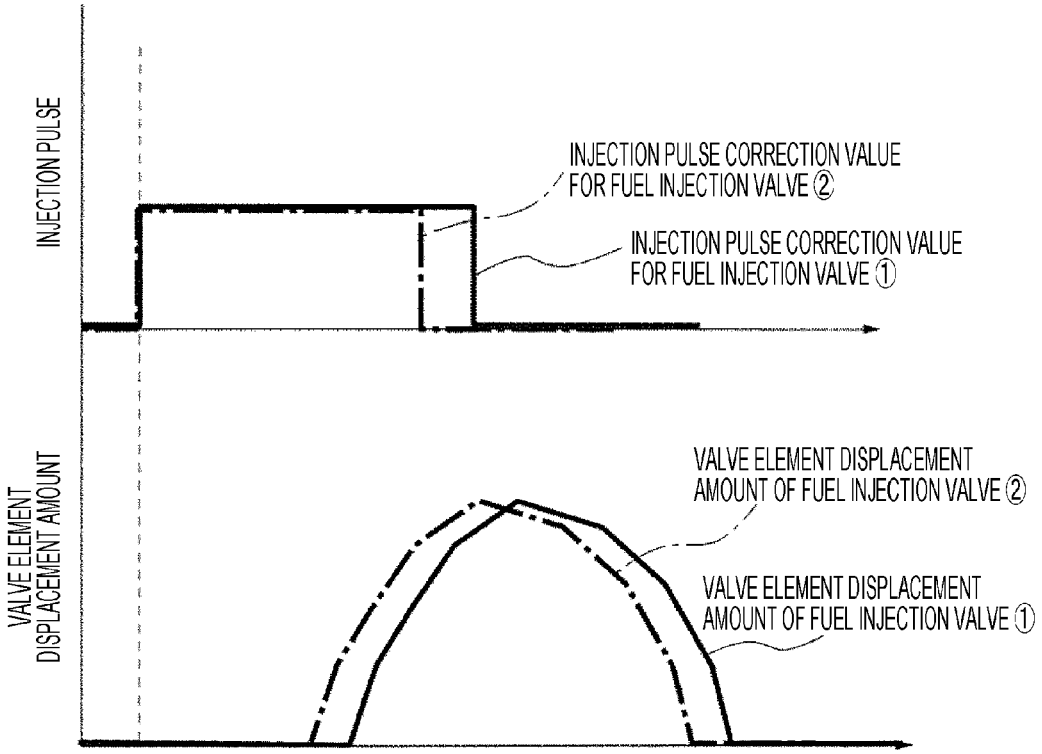
FIG. 10 is a diagram time-serially illustrating an example of injection pulse correction values and valve element displacement amounts of two fuel injection valves.

As such, even when the plurality of fuel injection valves are disposed in the internal combustion engine and the injection characteristic of each fuel injection valve changes on the basis of the spring characteristic or the solenoid characteristic of each fuel injection valve, the valve opening start time or the valve closing completion time is detected from the drive current flowing to the solenoid 3 of each fuel injection valve or the drive voltage. As a result, as illustrated in FIG. 10, an injection pulse according to an injection characteristic of each fuel injection valve can be generated and an injection amount of the fuel injected from each fuel injection valve can be approximated to a target fuel injection amount.

When the internal combustion engine has a plurality of cylinders and a fuel injection valve is disposed in each cylinder, control may be executed such that a valve opening start time or a valve closing completion time of other cylinder is matched with a valve opening start time or a valve closing completion time detected by a fuel injection valve disposed in a specific cylinder of the internal combustion engine, instead of matching a valve opening start time or a valve closing completion time with a reference valve opening start time or a reference valve closing completion time.

Figure 11:
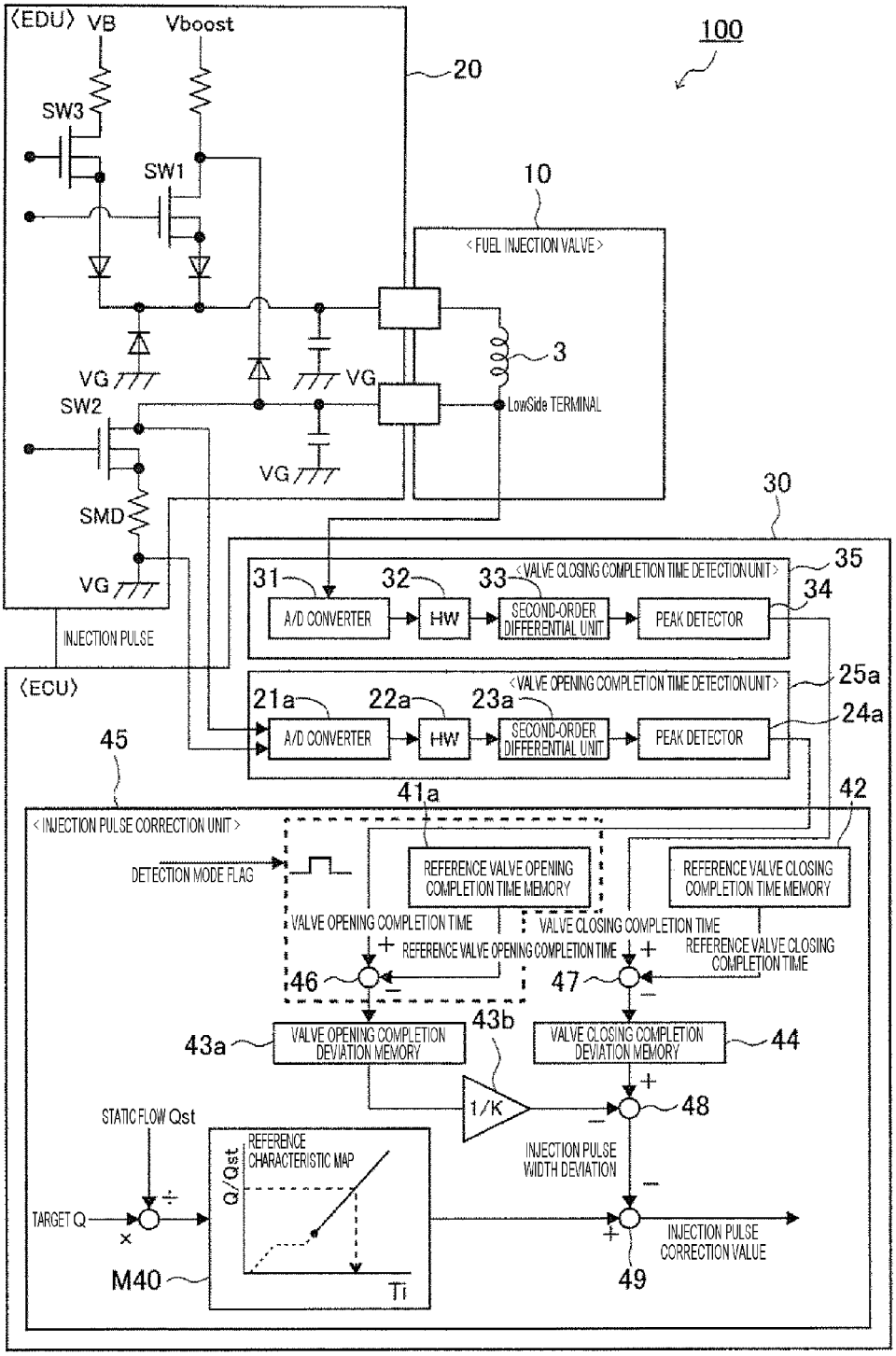
FIG. 11 is an internal configuration diagram schematically illustrating another example of an internal configuration of an ECU illustrated in FIG. 1.

In addition, FIG. 11 schematically illustrates another example of the internal configuration of the ECU illustrated in FIG. 1. In FIG. 11, the case in which, when the drive voltage applied to the solenoid 3 of the fuel injection valve 10 is relatively large and it is difficult to detect the change of the drive current flowing to the solenoid 3 at a point of time when the movable element 5 and the valve element 6 contact each other and the valve hole 7*a* is opened, as described on the basis of FIG. 4, the valve opening completion time or the valve closing completion time can be detected from the time when the inflection point is detected from the time series data of the drive current or the drive voltage of the solenoid 3 will be described. In addition, only the solenoid 3 in the configuration of the fuel injection valve 10 is illustrated in FIG. 11.

As illustrated in the drawing, the ECU 30 mainly includes a valve opening completion time detection unit 25*a* that detects a time corresponding to the valve opening completion time, a valve closing completion time detection unit 35 that detects a time corresponding to the valve closing completion time, and an injection pulse correction unit 45 that corrects an injection pulse output to the EDU 20 using the valve opening completion time detected by the valve opening completion time detection unit 25*a* and the valve closing completion time detected by the valve closing completion time detection unit 35.

The valve opening completion time detection unit 25*a* of the ECU 30 has an A/D converter 21*a* that executes A/D conversion on the voltage applied to the shunt resistor SMD provided between the LowSide terminal of the solenoid 3 of the fuel injection valve 10 and the ground voltage VG and obtains a signal proportional to a drive current, a Hanning Window 22*a* that smoothes a digitized drive current signal, a second-order differential unit 23*a* that calculates a second-order difference of the signal smoothened by the Hanning Window 22*a*, and a peak detector 24*a* that detects an extreme value from the signal in which the second-order difference is calculated by the second-order differential unit 23*a* and an inflection point is emphasized. The valve opening completion time detection unit 25*a* of the ECU 30 specifies a time closest to the reference valve opening completion time becoming a preset reference in a time when the extreme value is detected by the peak detector 24, detects a time corresponding to the valve opening completion time from a signal proportional to the drive current flowing to the solenoid 3, and transmits the detected valve opening completion time to the injection pulse correction unit 45.

In addition, the valve closing completion time detection unit 35 of the ECU 30 has an A/D converter 31 that executes A/D conversion on a voltage (drive voltage) of the LowSide terminal of the solenoid 3 of the fuel injection valve 10, a Hanning Window 32 that smoothes a digitized current signal, a second-order differential unit 33 that calculates a second-order difference of the signal smoothened by the Hanning Window 32, and a peak detector 34 that detects an extreme value from the signal in which the second-order difference is calculated by the second-order differential unit 33 and an inflection point is emphasized. The valve closing completion time detection unit 35 of the ECU 30 specifies a time closest to the reference valve closing completion time becoming a preset reference in a time when the extreme value is detected by the peak detector 34, detects a time corresponding to the valve closing completion time from the drive voltage applied to the solenoid 3, and transmits the detected valve closing completion time to the injection pulse correction unit 45.

In addition, the injection pulse correction unit 45 of the ECU 30 mainly has a reference characteristic map M40 that shows a relation of a value obtained by dividing a target fuel injection amount Q by a static flow Qst and a reference injection pulse width Ti based on a flow rate characteristic of the fuel injection valve 10, a reference valve opening completion time memory 41*a* that stores a valve opening completion time becoming a reference, a reference valve closing completion time memory 42 that stores a valve closing completion time becoming a reference, a valve opening completion deviation memory 43*a* that smoothes a variation for each injection and stores a valve opening completion deviation of the valve opening completion time transmitted from the valve opening completion time detection unit 25*a* and the reference valve opening completion time output from the reference valve opening completion time memory 41*a*, and a valve closing completion deviation memory 44 that smoothes a variation for each injection and stores a valve closing completion deviation of the valve closing completion time transmitted from the valve closing completion time detection unit 35 and the reference valve closing completion time output from the reference valve closing completion time memory 42. Here, the valve opening completion deviation memory 43*a* and the valve closing completion deviation memory 44 average a plurality of valve opening completion deviations and a plurality of valve closing completion deviations detected when the fuel is injected several times from the fuel injection valve 10 and store a valve opening completion deviation and a valve closing completion deviation averaged as a valve opening completion deviation and a valve closing completion deviation.

If a valve opening completion detection mode flag is set, the injection pulse correction unit 45 calculates a deviation of the valve opening completion time transmitted from the valve opening completion time detection unit 25*a* and the reference valve opening completion time output from the reference valve opening completion time memory 41*a* by a differential unit 46 and stores a calculation result as a valve opening completion deviation in the valve opening completion deviation memory 43*a*. In addition, the injection pulse correction unit 45 calculates a deviation of the valve closing completion time transmitted from the valve closing completion time detection unit 35 and the reference valve closing completion time output from the reference valve closing completion time memory 42 by a differential unit 47 and stores a calculation result as a valve closing completion deviation in the valve closing completion deviation memory 44.

Figure 12:
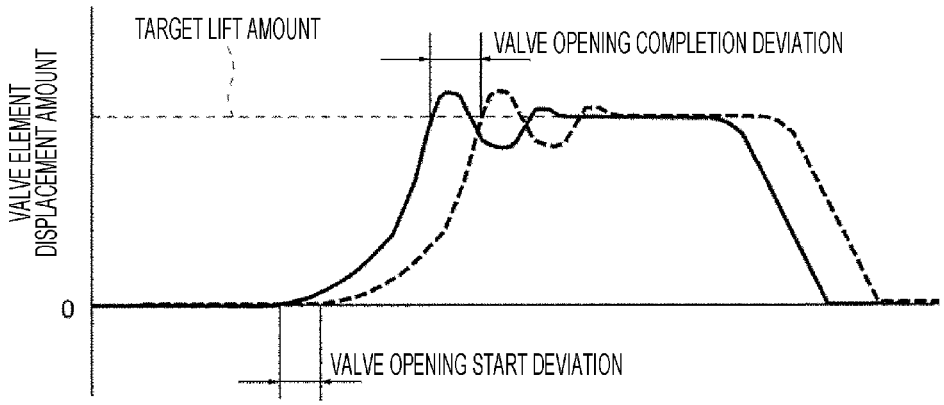
FIG. 12 is a schematic diagram schematically illustrating a relation of a valve opening start deviation and a valve opening completion deviation.

Here, as illustrated in FIG. 12, the valve opening start deviation and the valve opening completion deviation are correlated with each other. Generally, the valve opening completion deviation is approximately an integral multiple (K multiple) of the valve opening start deviation, regardless of the injection characteristic of each fuel injection valve.

Therefore, the injection pulse correction unit 45 integrates the valve opening completion deviation output from the valve opening completion deviation memory 43 with gain 1/K by a conversion unit 43*b* to calculate a valve opening start deviation, calculates an injection pulse width deviation of the valve opening start deviation and the valve closing completion deviation output from the valve closing completion deviation memory 44 by the differential unit 48, and calculates a deviation of the reference injection pulse width Ti output from the reference characteristic map M40 and the injection pulse width deviation by the differential unit 49, thereby generating a new injection pulse (injection pulse correction value) defining valve opening duration from the valve opening start to the valve closing completion.

As such, even when the plurality of fuel injection valves are disposed in the internal combustion engine and the injection characteristic of each fuel injection valve changes on the basis of the spring characteristic or the solenoid characteristic of each fuel injection valve, the valve opening completion time or the valve closing completion time is detected from the drive current flowing to the solenoid 3 of each fuel injection valve or the drive voltage. As a result, an injection pulse according to an injection characteristic of each fuel injection valve can be generated and an injection amount of the fuel injected from each fuel injection valve can be approximated to a target fuel injection amount.

[Second Embodiment]

In the first embodiment, the form in which the current signal digitized by the A/D converter is multiplied by the Hanning Window and a second-order difference of a calculation result thereof is calculated was described.

By the way, when a second-order difference of an output signal of the following formula (3) obtained by multiplying a signal $U_t$ by the Hanning Window (filter coefficient $F_t$) is calculated, deformation shown by the following formula (4) can be executed.

[Mathematical Formula 3]

$$Y_t = \sum_{i=0}^{l} F_i U_{t-i} \tag{3}$$

-continued

[Mathematical Formula 4]

$$\frac{Y_{t+i} - 2Y_t + Y_{t-1}}{\Delta^2} = \frac{\sum_{i=0}^{l} F_i U_{t+1-i} - 2\sum_{i=0}^{l} F_i U_{t-i} + \sum_{i=0}^{l} F_i U_{t-1-i}}{\Delta^2} = \frac{\left(F_0 U_{t+1} + F_1 U_t + \sum_{i=2}^{l} F_i U_{t+1-i}\right) - 2\left(F_0 U_t + \sum_{i=1}^{l-1} F_i U_{t-i} + F_l U_{t-l}\right) + \left(\sum_{i=0}^{l-2} F_i U_{t-1-i} + F_{l-1} U_{t-i} + F_l U_{t-1-l}\right)}{\Delta^2} = \frac{(F_0 U_{t+1} + F_1 U_t) - 2(F_0 U_t + F_l U_{t-l}) + (F_{l-1} U_{t-l} + F_l U_{t-1-l})}{\Delta^2} + \frac{\sum_{i=1}^{l-1} F_{i+1} U_{t-i} - 2\sum_{i=1}^{l-1} F_i U_{t-i} + \sum_{i=1}^{l-1} F_{i-1} U_{t-i}}{\Delta^2} = \frac{(F_0 U_{t+1} + F_1 U_t) - 2(F_0 U_t + F_j U_{t-l}) + (F_{t-1} U_{t-l} + F_l U_{t-1-l})}{\Delta^2} + \sum_{i=1}^{l-1} \frac{F_{i+1} - 2F_i + F_{i-1}}{\Delta^2} U_{t-i} \tag{4}$$

Figure 8A:
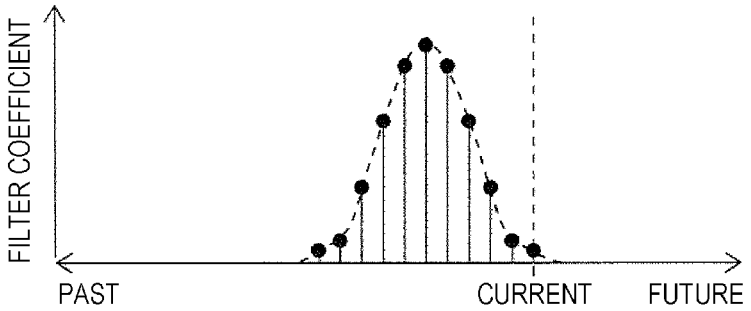
FIGS. 8A and 8B are diagrams illustrating a Hanning Window used when an inflection point is detected from a drive current or a drive voltage and FIG. 8A is a diagram illustrating a filter coefficient thereof and FIG. 8B is a diagram illustrating a frequency-gain characteristic thereof.
Figure 8B:
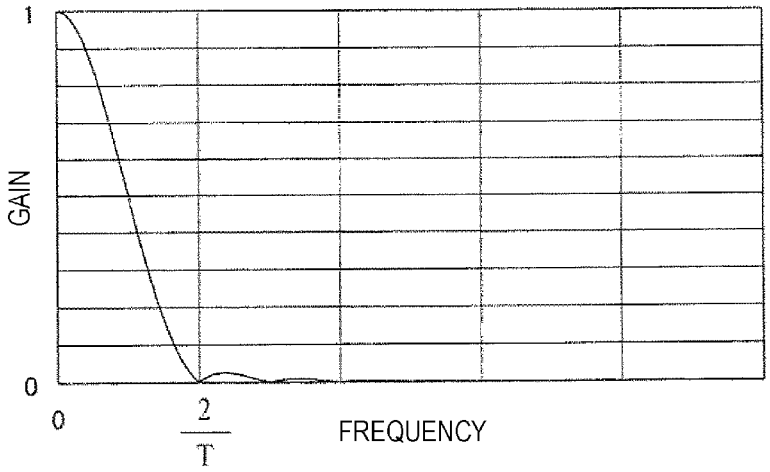
Figure 13A:
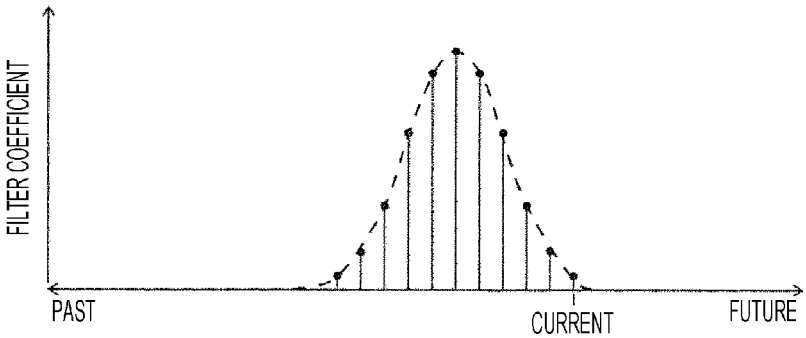
FIG. 13A is a diagram illustrating a filter coefficient of a Hanning Window and FIG. 13B is a diagram illustrating a filter coefficient of second-order differentiation of the Hanning Window.
Figure 13B:
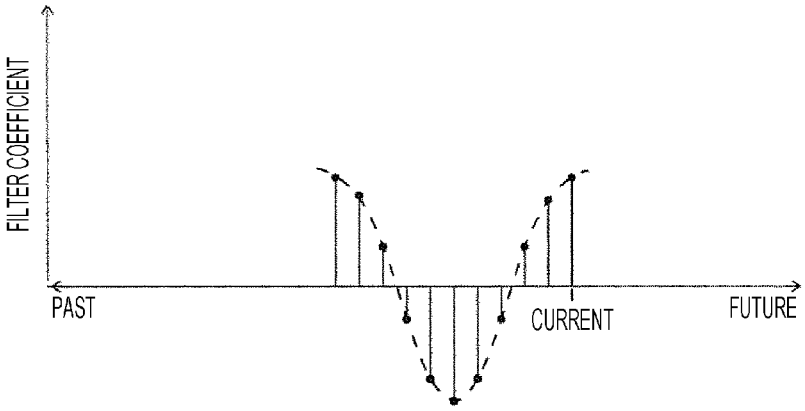

Here, as illustrated in FIGS. 8 and 13(*a*), because filter coefficients of both ends of the Hanning Window may be considered as 0, a first term of the formula (4) can be approximated to 0, as shown by the following formula (5).

[Mathematical Formula 5]

$$\frac{(F_0 U_{i+1} + F_1 U_t) - 2(F_0 U_1 + F_l U_{t-l}) + (F_{l-1} U_{t-l} + F_l U_{t-1-l})}{\Delta^2} = 0 \tag{5}$$

Meanwhile, because a second term of the formula (4) is convolution of a second-order difference of $F_t$ and $U_t$, calculating the second-order difference after multiplying the signal $U_t$ by the Hanning Window is equalized to multiplying the signal $U_t$ by the second-order difference of the Hanning Window. The filter coefficient of the Hanning Window is represented by $F_i = 1 - \cos(2\pi i/I)$, as shown by the formula (2). For this reason, the second-order difference of the filter coefficient of the Hanning Window is represented by the following formula (6) using a proportional constant KA.

[Mathematical Formula 6]

$$\frac{F_{i+1} - 2F_i + F_{i-1}}{\Delta^2} = KA\cos(2\pi i/I) \tag{6}$$

Therefore, calculating the second-order difference after multiplying the signal $U_t$ by the Hanning Window is equalized to taking convolution of a filter having a level corrected such that a total sum or an average of coefficients becomes 0 by overturning the Hanning Window as illustrated in FIG. 13(*b*) and the signal $U_t$.

Figure 14A:
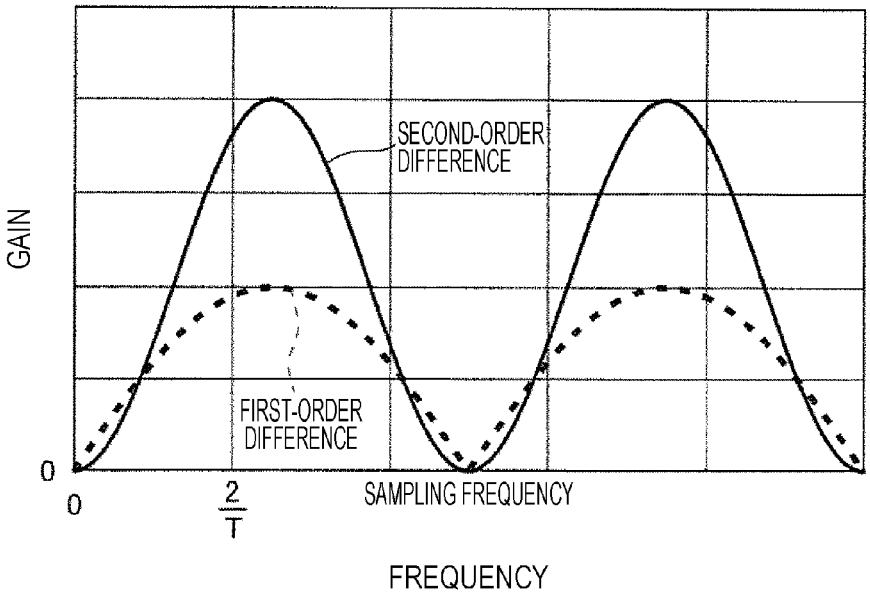
FIGS. 14A and 14B are diagrams illustrating a high-pass extraction filter used when an inflection point is detected from a drive current or a drive voltage and FIG. 14A is a diagram illustrating a frequency-gain characteristic of second-order difference which a frequency-gain characteristic of a Hanning Window illustrated in FIG. 8B is multiplied by and FIG. 14B is a diagram illustrating a frequency-gain characteristic thereof.
Figure 14B:
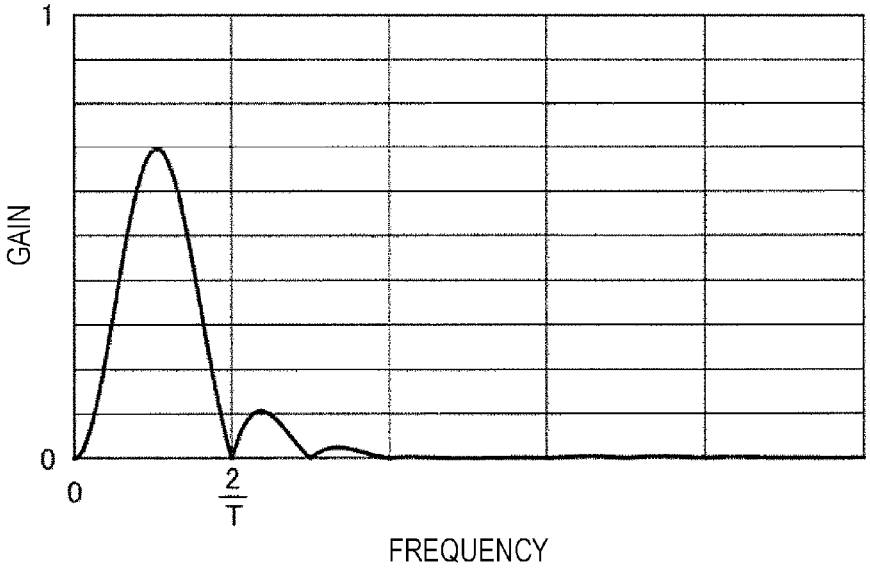

Because the filter is series coupling of the Hanning Window and the second-order difference, a frequency-gain characteristic of the filter is obtained by multiplying the frequency-gain characteristic of the Hanning Window illustrated in FIG. 8(*b*) by a frequency-gain characteristic of a second-order difference illustrated in FIG. 14(*a*) and is as illustrated in FIG. 14(*b*). In the filter, gain is low at a low frequency of the vicinity of 0, the gain increases when the frequency increases and approaches a cut-off frequency, and if the frequency exceeds the cut-off frequency, the gain becomes about 0.

That is, because the filter has a characteristic of passing a frequency close to the cut-off frequency more securely than the low frequency, the filter is called a high-pass extraction filter.

Figure 15:
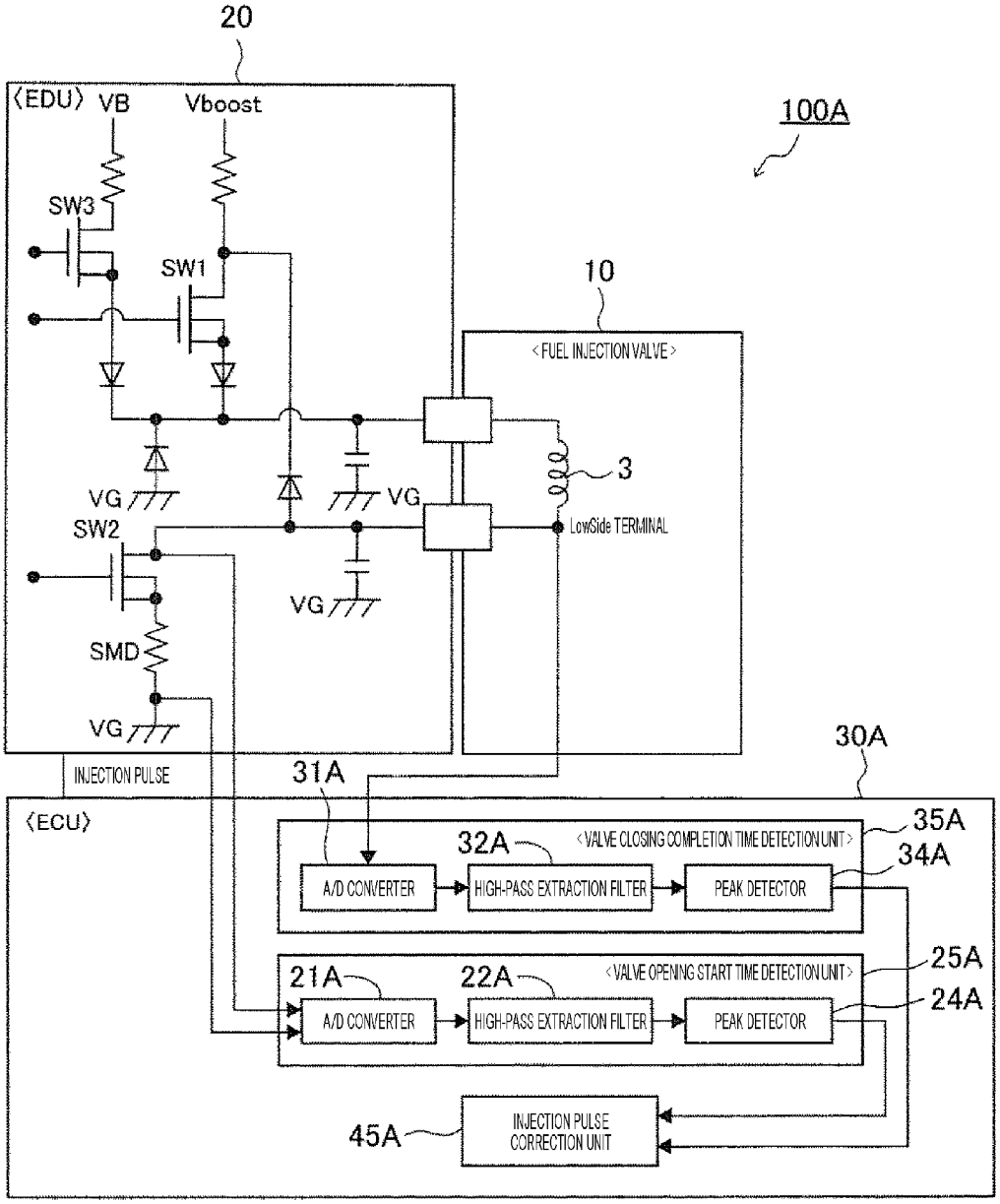
FIG. 15 is an entire configuration diagram illustrating an entire configuration of a fuel injection device to which an internal combustion engine control device using a second embodiment of an electromagnetic valve control unit according to the present invention is applied.

FIG. 15 illustrates an entire configuration of a fuel injection device to which an internal combustion engine control device using a second embodiment of an electromagnetic valve control unit according to the present invention is applied and illustrates a control device using the high-pass extraction filter in particular. In FIG. 15, only a solenoid 3 in a configuration of a fuel injection valve 10 is illustrated.

The control device according to the second embodiment illustrated in FIG. 15 is different from the control device according to the first embodiment in a method of detecting an inflection point from time series data of a drive current flowing to the solenoid 3 or a drive voltage applied to the solenoid 3 and detecting a valve opening start time or a valve opening completion time and a valve closing completion time and the other configuration thereof is the same as the configuration of the control device according to the first embodiment. Therefore, the same components as the components of the control device according to the first embodiment are denoted with the same reference numerals and detailed description thereof is omitted.

As illustrated in the drawing, an ECU 30A mainly includes a valve opening start time detection unit (or a valve opening completion time detection unit) 25A that detects a time corresponding to a valve opening start time (or a valve opening completion time), a valve closing completion time detection unit 35A that detects a time corresponding to a valve closing completion time, and an injection pulse correction unit 45A that corrects an injection pulse output to an EDU 20 using the valve opening start time (or the valve opening completion time) detected by the valve opening start time detection unit (or the valve opening completion time detection unit) 25A and the valve closing completion time detected by the valve closing completion time detection unit 35A.

The valve opening start time detection unit (or the valve opening completion time detection unit) 25A of the ECU 30A has an A/D converter 21A that executes A/D conversion on a voltage applied to a shunt resistor SMD provided between a LowSide terminal of the solenoid 3 of the fuel injection valve 10 and a ground voltage VG and obtains a signal proportional to a drive current, a high-pass extraction filter (refer to FIG. 13(*b*)) 22A that emphasizes a high frequency component of a digitized drive current signal, and a peak detector 24A that detects an extreme value from an output signal (correlation of the digitized drive current signal and the high-pass extraction filter) of the high-pass extraction filter 22A. The valve opening start time detection unit (or the valve opening completion time detection unit) 25A of the ECU 30A specifies a time closest to the reference valve opening start time (or the reference valve opening completion time) becoming a preset reference in a time when the extreme value is detected by the peak detector 24A, detects a time corresponding to the valve opening start time (or the valve opening completion time) from a signal proportional to the drive current flowing through the solenoid 3, and transmits the detected valve opening start time (or the valve opening completion time) to an injection pulse correction unit 45A.

In addition, the valve closing completion time detection unit 35A of the ECU 30A has an A/D converter 31A that executes A/D conversion on a voltage (drive voltage) of the LowSide terminal of the solenoid 3 of the fuel injection valve 10, a high-pass extraction filter 32A that emphasizes a high frequency component of a digitized current signal, and a peak detector 34A that detects an extreme value from an output signal (correlation of the digitized current signal and the high-pass extraction filter) of the high-pass extraction filter 32A. The valve closing completion time detection unit 35A of the ECU 30A specifies a time closest to the reference valve closing completion time becoming a preset reference in a time when the extreme value is detected by the peak detector 34A, detects a time corresponding to the valve closing completion time from the drive voltage applied to the solenoid 3, and transmits the detected valve closing completion time to the injection pulse correction unit 45A.

In addition, the injection pulse correction unit 45A of the ECU 30A generates a new injection pulse (injection pulse correction value) defining valve opening duration from the valve opening start to the valve closing completion, on the basis of the valve opening start time (or the valve opening completion time) transmitted from the valve opening start time detection unit (or the valve opening completion time detection unit) 25A and the valve closing completion time transmitted from the valve closing completion time detection unit 35A. The ECU 30A controls an operating state of each of switches SW1, SW2, and SW3 of the EDU 20, on the basis of the injection pulse correction value, controls the drive voltage applied to the solenoid 3 of the fuel injection valve 10 or the drive current flowing to the solenoid 3, appropriately controls opening/closing of a valve hole 7*a* of the fuel injection valve 10, and controls an injection amount of the fuel injected from the fuel injection valve 10 to become a target fuel injection amount.

As such, in the second embodiment, when the valve opening start time or the valve opening completion time and the valve closing completion time are detected from the time series data of the drive current flowing to the solenoid 3 or the drive voltage applied to the solenoid 3, the high-pass extraction filter in which a total sum or an average of coefficients is 0 and the moment of the coefficients is 0 is used and the extreme value is detected from the correlation of the high-pass extraction filter and the time series data of the drive current or the drive voltage. As a result, the valve opening start time or the valve opening completion time and the valve closing completion time of each fuel injection valve can be detected with a simple configuration.

Figure 16A:
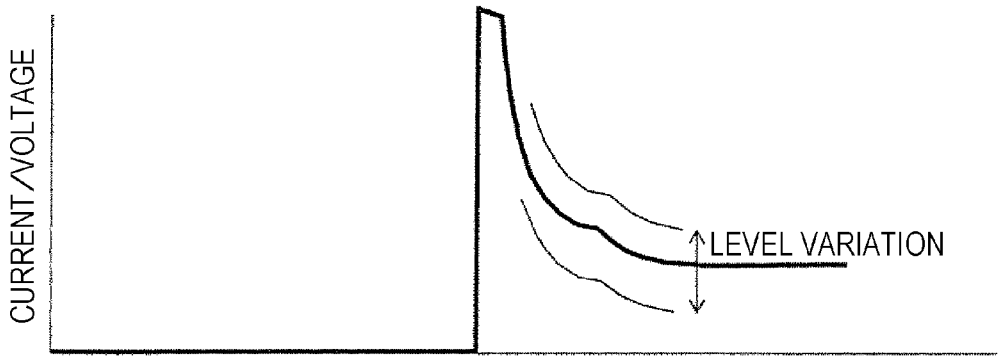
FIGS. 16A and 16B are schematic diagrams schematically illustrating a variation of a drive current or a drive voltage and FIG. 16A is a diagram illustrating a variation of a level of the drive current or the drive voltage and FIG. 16B is a diagram illustrating a variation of an inclination of the drive current or the drive voltage.
Figure 16B:
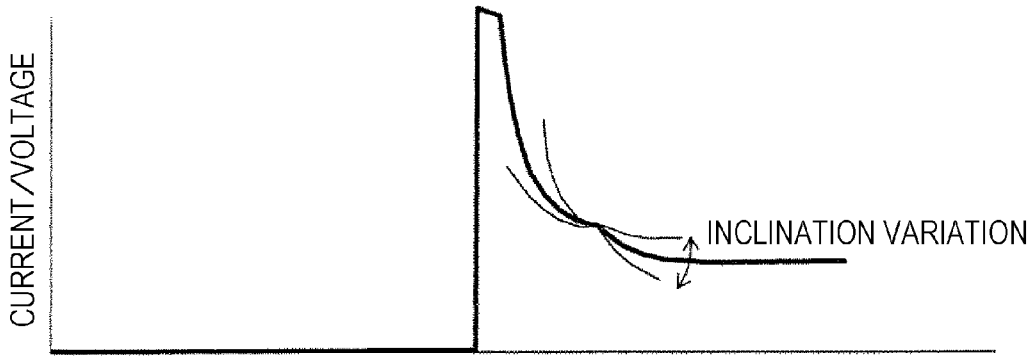

In addition, in the second embodiment, the filter in which a filter coefficient was KA $\cos(2\pi i/I)$ (a trigonometric function) was described as the high-pass extraction filter to emphasize the high frequency component of the digitized current signal. The high-pass extraction filter may detect the inflection point from the time series data of the drive voltage or the drive current, regardless of the variation of the level of the drive voltage or the drive current illustrated in FIG. 16(*a*), and may detect the inflection point from the time series data of the drive voltage or the drive current, regardless of the variation of the inclination of the drive voltage or the drive current illustrated in FIG. 16(*b*). For this reason, the filter in which a total sum or an average of filter coefficients is 0 and the moment of the filter coefficients is 0 may be used as the high-pass extraction filter. That is, as the high-pass extraction filter, for example, a filter (represented by an even-numbered order function to be linear symmetry for a predetermined axis of symmetry) illustrated in FIG. 17(*a*) in which a filter coefficient has a shape of a circular arc to be convex downward and a level is adjusted, a filter illustrated in FIG. 17(*b*) in which a filter coefficient is represented by an even-numbered order function such as a quadratic function and a level is adjusted, a filter (represented by a linear function to be linear symmetry for a predetermined axis of symmetry) illustrated in FIG. 17(*c*) in which a filter coefficient has a shape of V to be convex downward and a level is adjusted, or a filter obtained by combining the filters appropriately may be used.

[Third Embodiment]

Figure 17A:
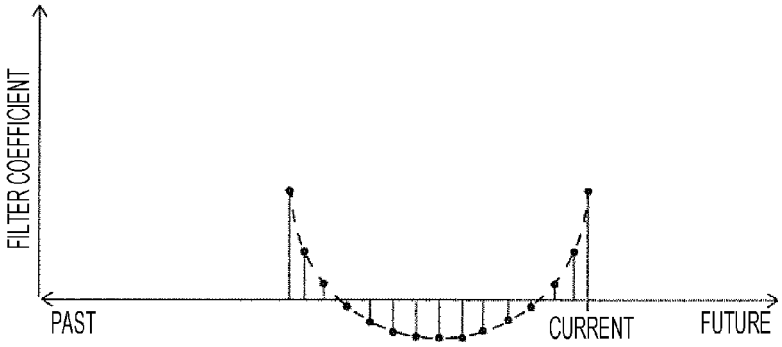
FIG. 17A is a diagram illustrating an example of a high-pass extraction filter used when an inflection point is detected from a drive current or a drive voltage.
Figure 17B:
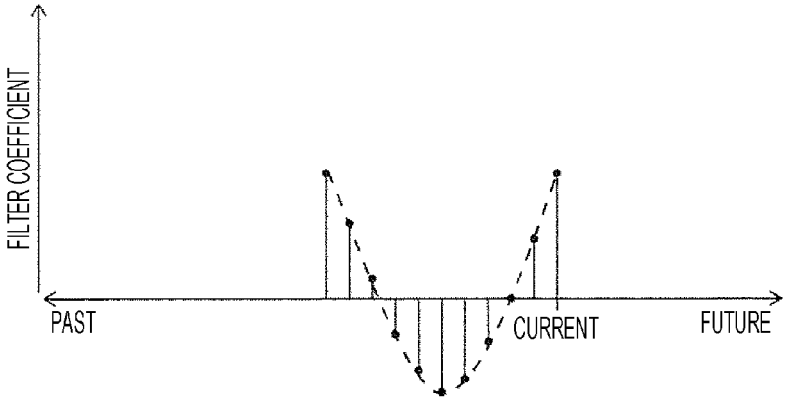
FIG. 17B is a diagram illustrating another example of the high-pass extraction filter used when the inflection point is detected from the drive current or the drive voltage.
Figure 17C:
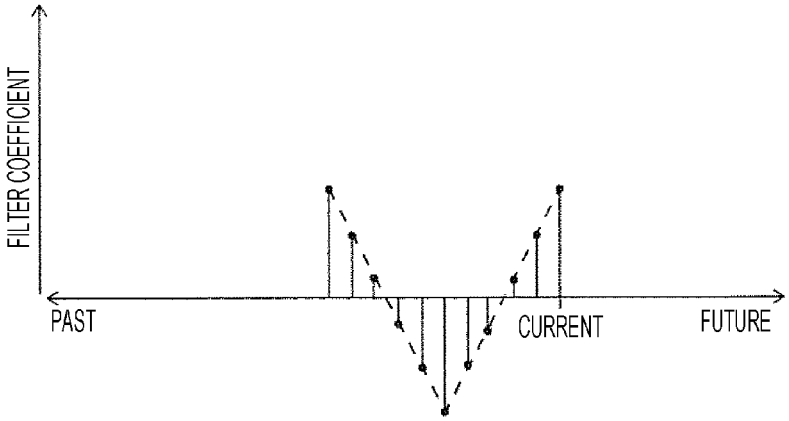
FIG. 17C is a diagram illustrating still another example of the high-pass extraction filter used when the inflection point is detected from the drive current or the drive voltage.
Figure 18:
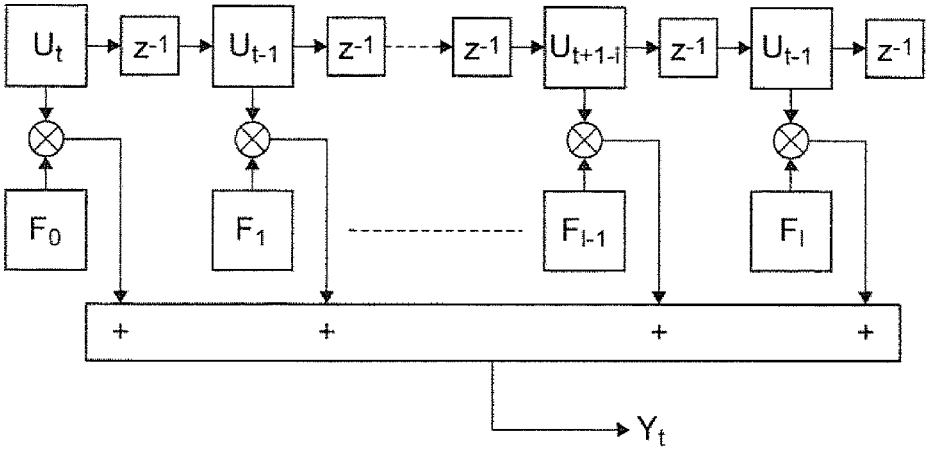
FIG. 18 is a schematic diagram schematically illustrating an output when a signal is input to a filter.
Figure 19:
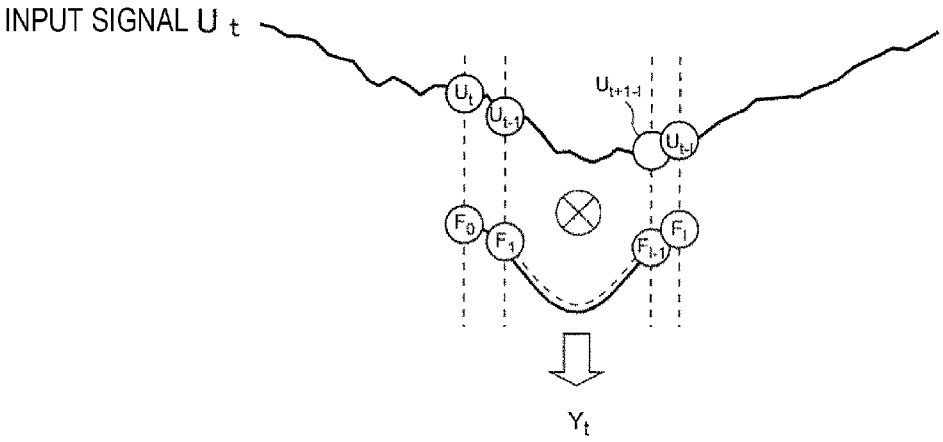
FIG. 19 is a schematic diagram schematically illustrating an output when a signal is input to a filter.

An output Y when a signal U is input to the filter having the filter coefficient $F_i$ illustrated in FIGS. 13(*a*) and 13(*b*) or FIGS. 17(*a*) to 17(*c*) is represented by the formula (3). The formula (3) can be represented as illustrated in FIG. 18 or 19. That is, as illustrated in FIG. 19, the formula (3) represents taking a correlation of a reference pattern having the same characteristic as the filter and the input signal U. In FIG. 19, a symbol in which a mark is surrounded with a circle represents an operation to take a correlation of inputs $U_t$, . . . , and $U_{t-1}$ and $F_0$, . . . , and $F_1$.

Figure 20:
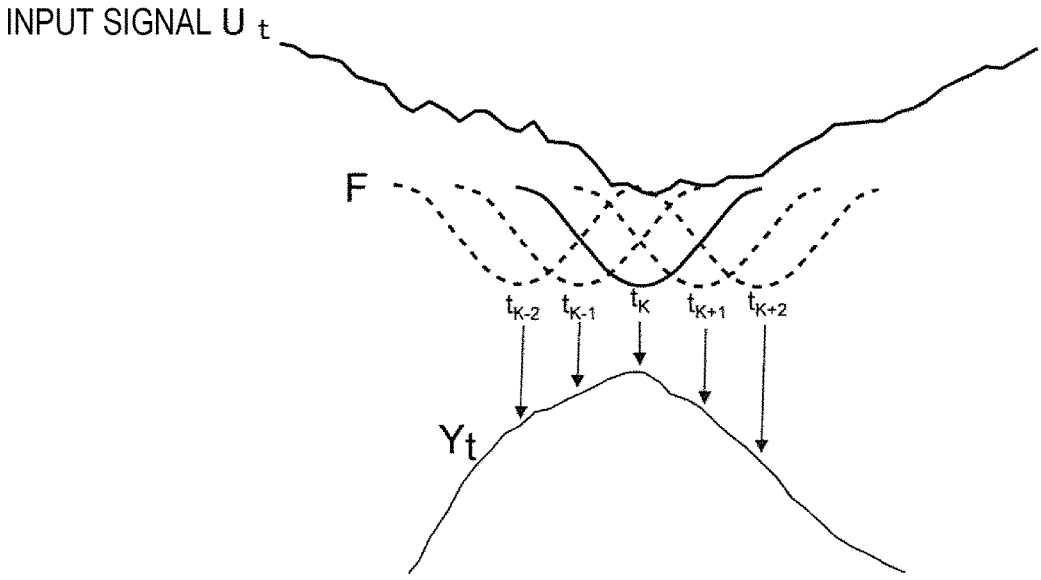
FIG. 20 is a schematic diagram schematically illustrating a method of detecting an extreme value from a correlation of a reference pattern and a signal.

In addition, when a peak (extreme value) is detected from the correlation of the reference pattern and the input signal U, this means that the reference patterns are shifted like $t_{k-2}$, $t_{k-1}$, $t_k$, $t_{k+1}$, and $t_{k+2}$ (refer to FIG. 20), correlations with the input signals U are calculated at positions of the individual reference patterns, and a position ($t_k$ in FIG. 20) where the calculated correlation becomes relatively high among the positions of the individual reference patterns is specified.

Figure 21:
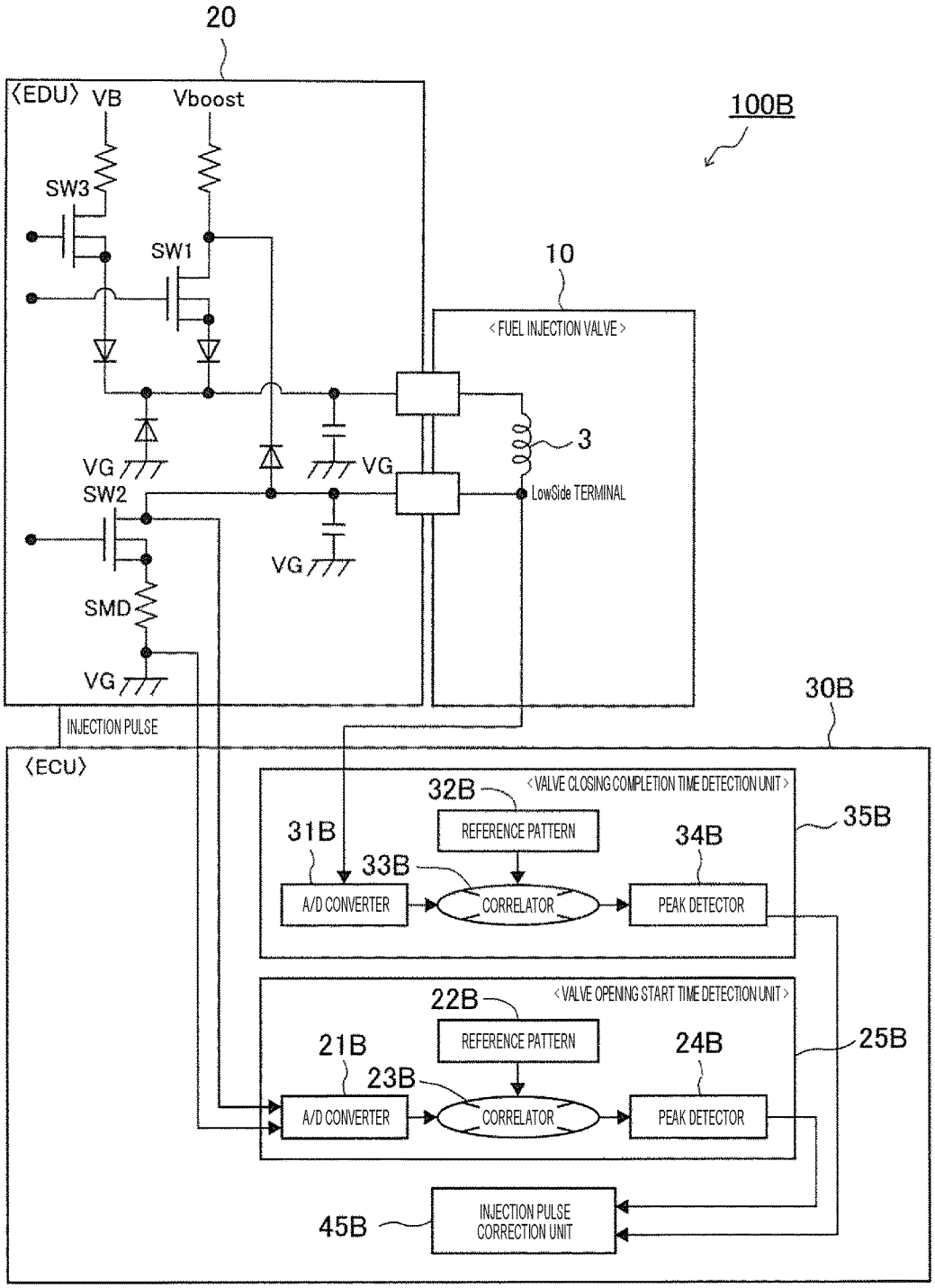
FIG. 21 is an entire configuration diagram illustrating an entire configuration of a fuel injection device to which an internal combustion engine control device using a third embodiment of an electromagnetic valve control unit according to the present invention is applied.
Figure 22:
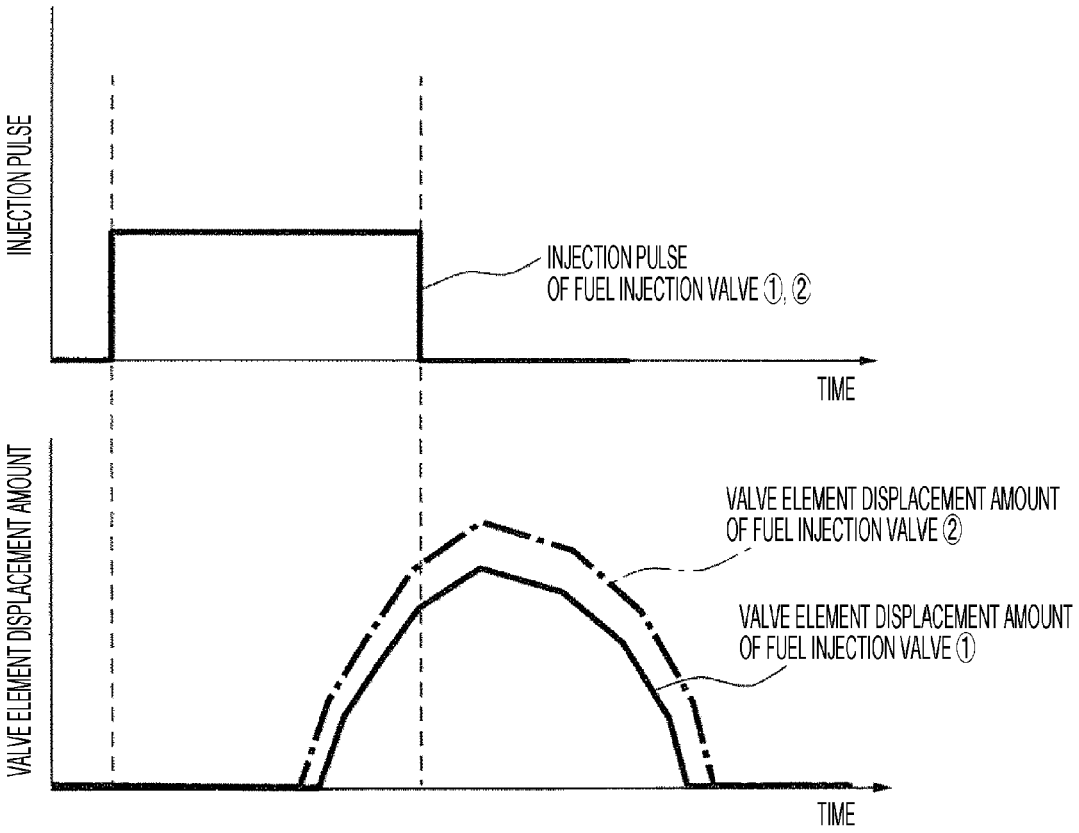
FIG. 22 is a diagram time-serially illustrating an injection pulse and a displacement amount of a valve element when fuel is injected from a fuel injection valve of a fuel injection device according to the related art.

FIG. 21 illustrates an entire configuration of a fuel injection device to which an internal combustion engine control device using a third embodiment of an electromagnetic valve control unit according to the present invention is applied and illustrates a control device using the reference pattern having the same characteristic as the high-pass extraction filter in particular. In FIG. 21, only a solenoid 3 in a configuration of a fuel injection valve 10 is illustrated.

The control device according to the third embodiment illustrated in FIG. 21 is different from the control device according to the first embodiment in a method of detecting an inflection point from time series data of a drive current flowing to the solenoid 3 or a drive voltage applied to the solenoid 3 and detecting a valve opening start time or a valve opening completion time and a valve closing completion time and the other configuration thereof is the same as the configuration of the control device according to the first embodiment. Therefore, the same components as the components of the control device according to the first embodiment are denoted with the same reference numerals and detailed description thereof is omitted.

As illustrated in the drawing, an ECU 30B mainly includes a valve opening start time detection unit (or a valve opening completion time detection unit) 25B that detects a time corresponding to the valve opening start time (or the valve opening completion time), a valve closing completion time detection unit 35B that detects a time corresponding to the valve closing completion time, and an injection pulse correction unit 45B that corrects an injection pulse output to an EDU 20 using the valve opening start time (or the valve opening completion time) detected by the valve opening start time detection unit (or the valve opening completion time detection unit) 25B and the valve closing completion time detected by the valve closing completion time detection unit 35.

The valve opening start time detection unit (or the valve opening completion time detection unit) 25B of the ECU 30B has an A/D converter 21B that executes A/D conversion on a voltage applied to a shunt resistor SMD provided between a LowSide terminal of the solenoid 3 of the fuel injection valve 10 and a ground voltage VG and obtains a signal proportional to a drive current, a reference pattern (a total sum or an average of coefficients and the moment of the coefficients are 0) 22B that emphasizes a high frequency component of a signal, a correlator 23B that takes a correlation of a drive current signal digitized by the A/D converter 21B and the reference pattern 22B, and a peak detector 24B that detects an extreme value from an output result of the correlator 23B. The valve opening start time detection unit (or the valve opening completion time detection unit) 25B of the ECU 30B specifies a time closest to the reference valve opening start time (or the reference valve opening completion time) becoming a preset reference in a time when the extreme value is detected by the peak detector 24B, detects a time corresponding to the valve opening start time (or the valve opening completion time) from a signal proportional to the drive current flowing through the solenoid 3, and transmits the detected valve opening start time (or the valve opening completion time) to the injection pulse correction unit 45B.

In addition, the valve closing completion time detection unit 35B of the ECU 30B has an A/D converter 31B that executes A/D conversion on a voltage (drive voltage) of the LowSide terminal of the solenoid 3 of the fuel injection valve 10, a reference pattern (a total sum or an average of coefficients and the moment of the coefficients are 0) 32B that emphasizes a high frequency component of a signal, a correlator 33B that takes a correlation of a current signal digitized by the A/D converter 31B and the reference pattern, and a peak detector 34B that detects an extreme value from an output result of the correlator 33B. The valve closing completion time detection unit 35B of the ECU 30B specifies a time closest to the reference valve closing completion time becoming a preset reference in a time when the extreme value is detected by the peak detector 34B, detects a time corresponding to the valve closing completion time from the drive voltage applied to the solenoid 3, and transmits the detected valve closing completion time to the injection pulse correction unit 45B.

In addition, the injection pulse correction unit 45B of the ECU 30B generates a new injection pulse (injection pulse correction value) defining valve opening duration from the valve opening start to the valve closing completion, on the basis of the valve opening start time (or the valve opening completion time) transmitted from the valve opening start time detection unit (or the valve opening completion time detection unit) 25B and the valve closing completion time transmitted from the valve closing completion time detection unit 35B. The ECU 30B controls an operating state of each of switches SW1, SW2, and SW3 of the EDU 20, on the basis of the injection pulse correction value, controls the drive voltage applied to the solenoid 3 of the fuel injection valve 10 or the drive current flowing to the solenoid 3, appropriately controls opening/closing of a valve hole 7*a* of the fuel injection valve 10, and controls the injection amount of the fuel injected from the fuel injection valve 10 to become a target fuel injection amount.

As such, in the third embodiment, when the valve opening start time or the valve opening completion time and the valve closing completion time are detected from the time series data of the drive current flowing to the solenoid 3 or the drive voltage applied to the solenoid 3, the reference pattern having the same characteristic as the high-pass extraction filter in which a total sum or an average of coefficients is 0 and the moment of the coefficients is 0 is used and the extreme value is detected from the correlation of the reference pattern and the time series data of the drive current or the drive voltage. As a result, the valve opening start time or the valve opening completion time and the valve closing completion time can be precisely detected with a simple configuration.

The present invention is not limited to the first to third embodiments described above and various modifications are included in the present invention. For example, the first to third embodiments are described in detail to facilitate the description of the present invention and the present invention is not limited to embodiments in which all of the described configurations are included. In addition, a part of the configurations of the certain embodiment can be replaced by the configurations of another embodiment or the configurations of another embodiment can be added to the configurations of the certain embodiment. In addition, for a part of the configurations of the individual embodiments, addition, removal, and replacement of other configurations can be performed.

In addition, only control lines or information lines necessary for explanation are illustrated and the control lines or information lines do not mean all control lines or information lines necessary for a product. In actuality, almost all configurations may be connected to each other.

REFERENCE SIGNS LIST

1 fixed core
2 regulator
3 solenoid
3*a* bobbin
3*b* housing
4 set spring
5 movable element
5*a* movable element guide
6 valve element
6*a* protrusion portion
6*b* lower end of valve element
7 valve seat
7*a* valve hole
8 guide member
9 cylindrical body
10 fuel injection valve (electromagnetic valve)
20 engine drive unit (EDU) (drive circuit)
21, 31 A/D converter
22, 32 Hanning Window
23, 33 second-order differential unit
24, 34 peak detector
25 valve opening start time detection unit
30 engine control unit (ECU) (internal combustion engine control device)
35 valve closing completion time detection unit
41 reference valve opening start time memory
42 reference valve closing completion time memory
43 valve opening start deviation memory
44 valve closing completion deviation memory
45 injection pulse correction unit
46, 47, 48, 49 differential unit
100 fuel injection device

The invention claimed is:

1. A control system comprising:

a controller that includes a high-pass extraction filter, and that is configured to control opening and closing of an electromagnetic valve using a drive voltage or drive current, wherein the controller is also configured to:

perform second-order differentiation of time series data of the drive voltage or drive current, and correct the drive voltage or drive current applied to the electromagnetic valve based on a time when a correlation of the time series data of the drive voltage or drive current and a reference pattern having a same frequency characteristic as the high-pass extraction filter in which both a total sum of filter coefficients and the moment of the filter coefficients are 0 become an extreme value, and the drive voltage or drive current that is applied to the electromagnetic valve is corrected based on a detection time of an inflection point from the second-order differentiation of time series data of the drive voltage or drive current when the electromagnetic valve is open or closed.

2. The control system according to claim 1, wherein the controller is configured to detect a valve closing completion time of the electromagnetic valve based on the detection time of the inflection point from the time series data of the drive voltage or drive current, or detect a valve opening start time or a valve opening completion time of the electromagnetic valve based on the detection time of the inflection point from the time series data of the drive current, and corrects the drive voltage or the drive current that is applied to the electromagnetic valve.

3. The control system according to claim 2, wherein the controller is configured to detect the valve closing completion time of the electromagnetic valve based on the detection time of the inflection point from the time series data of the drive voltage, detect the valve opening start time of the electromagnetic valve based on the detection time of the inflection point from the time series data of the drive current, and correct the drive voltage or the drive current applied to the electromagnetic valve based on a time width from the valve opening start time to the valve closing completion time.

4. The control system according to claim 1, wherein the reference pattern is a trigonometric function or an even-numbered order function to be linear symmetry for a predetermined axis of symmetry.

5. The control system according to claim 1, wherein the controller is configured to correct the drive voltage or the drive current applied to the electromagnetic valve based on a detection time of an extreme value from a second-order difference of convolution of the time series data of the drive voltage or the drive current and a Hanning Window.

6. The control system according to claim 2, wherein the controller is configured to control the drive voltage or the drive current applied to the electromagnetic valve based on a valve opening start deviation of the valve opening start time and a preset reference valve opening start time of the electromagnetic valve and a valve closing completion deviation of the valve closing completion time and a preset reference valve closing completion time of the electromagnetic valve.

7. The control system according to claim 2, wherein the controller is configured to control the drive voltage or the drive current applied to the electromagnetic valve based on a valve opening start deviation obtained by multiplying a valve opening completion deviation of the valve opening completion time and a preset reference valve opening completion time of the electromagnetic valve by a predetermined value and a valve closing completion deviation of the valve closing completion time and a preset reference valve closing completion time of the electromagnetic valve.

8. An internal combustion engine control system comprising:

a first controller that controls the internal combustion engine; and a second controller that controls an electromagnetic valve and that includes a high-pass extraction filter, and that is configured to control opening and closing of the electromagnetic valve using a drive current, wherein the second controller is also configured to:

perform second-order differentiation of time series data of the drive current, correct the drive current that is applied to the electromagnetic valve, based on a detection time of an inflection point from the second-order differentiation of time series data of the drive current when the electromagnetic valve is open or closed, correct the drive current applied to the electromagnetic valve based on a time when a correlation of the time series data of the drive current and a reference pattern having a same frequency characteristic as the high-pass extraction filter in which both a total sum of filter coefficients and the moment of the filter coefficients are 0 become an extreme value, detect a valve closing completion time of the electromagnetic valve based on the detection time of the inflection point from the time series data of a drive voltage, or detect a valve opening start time or a valve opening completion time of the electromagnetic valve based on the detection time of the inflection point from the time series data of the drive current, and corrects the drive voltage or the drive current that is applied to the electromagnetic valve, control the drive voltage or the drive current applied to the electromagnetic valve based on a valve opening start deviation of the valve opening start time and a preset reference valve opening start time of the electromagnetic valve and a valve closing completion deviation of the valve closing completion time and a preset reference valve closing completion time of the electromagnetic valve, wherein the electromagnetic valve is an electromagnetic fuel injection valve that is configured to inject fuel of a target fuel injection amount into a combustion chamber of an internal combustion engine, and wherein the first controller is configured to correct the drive voltage or the drive current applied to the fuel injection valve based the valve opening start deviation, the valve closing completion deviation, and a reference injection pulse width obtained from the target fuel injection amount of the fuel injection valve and a reference characteristic map of the fuel injection valve.

9. The internal combustion engine control system according to claim 8, wherein the valve opening start deviation or the valve closing completion deviation is obtained by averaging a plurality of valve opening start deviations or a plurality of valve closing completion deviations detected when the fuel is injected several times from the fuel injection valve.

10. The internal combustion engine control system according to claim 8, wherein the internal combustion engine has a plurality of cylinders and the second controller is configured to set a reference valve opening start time or a reference valve closing completion time of a fuel injection valve disposed in each cylinder of the internal combustion engine to the valve opening start time or the valve closing completion time of a fuel injection valve disposed in a predetermined cylinder of the internal combustion engine.

11. An internal combustion engine control system comprising:

a first controller that controls the internal combustion engine; and a second controller that controls an electromagnetic valve and that includes a high-pass extraction filter, and that is configured to control opening and closing of the electromagnetic valve using a drive voltage or drive current, wherein the second controller is also configured to:

control opening and closing of the electromagnetic valve using a drive current, perform second-order differentiation of time series data of the drive current, correct the drive current that is applied to the electromagnetic valve based on a detection time of an inflection point from the second-order differentiation of time series data of the drive current when the electromagnetic valve is open or closed, correct the drive current applied to the electromagnetic valve based on a time when a correlation of the time series data of the drive current and a reference pattern having a same frequency characteristic as the high-pass extraction filter in which both a total sum of filter coefficients and the moment of the filter coefficients are 0 become an extreme value, detect the valve closing completion time of the electromagnetic valve based on the detection time of the inflection point from the time series data of the drive voltage, detect the valve opening start time of the electromagnetic valve based on the detection time of the inflection point from the time series data of the drive current, and correct the drive voltage or the drive current applied to the electromagnetic valve based on a time width from the valve opening start time to the valve closing completion time, control the drive voltage or the drive current applied to the electromagnetic valve based on a valve opening start deviation obtained by multiplying a valve opening completion deviation of the valve opening completion time and a preset reference valve opening completion time of the electromagnetic valve by a predetermined value and a valve closing completion deviation of the valve closing completion time and a preset reference valve closing completion time of the electromagnetic valve, wherein the electromagnetic valve is an electromagnetic fuel injection valve that is configured to inject fuel of a target fuel injection amount into a combustion chamber of an internal combustion engine, and the first controller is configured to correct the drive voltage or the drive current applied to the fuel injection valve based on the valve opening start deviation, the valve closing completion deviation, and a reference injection pulse width obtained from the target fuel injection amount of the fuel injection valve and a reference characteristic map of the fuel injection valve.

12. The internal combustion engine control system according to claim 11, wherein the second controller is configured to calculate the valve opening start deviation by multiplying the valve opening completion deviation by a predetermined value.

13. The internal combustion engine control system according to claim 11, wherein the valve opening completion deviation or the valve closing completion deviation is obtained by averaging a plurality of valve opening completion deviations or a plurality of valve closing completion deviations detected when the fuel is injected several times from the fuel injection valve.

14. The internal combustion engine control system according to claim 11, wherein the internal combustion engine has a plurality of cylinders and the second controller sets a reference valve opening completion time or a reference valve closing completion time of a fuel injection valve disposed in each cylinder of the internal combustion engine to the valve opening start time or the valve closing completion time of a fuel injection valve disposed in a predetermined cylinder of the internal combustion engine.

* * * * *